US009206749B2

(12) United States Patent
Cleeves

(10) Patent No.: US 9,206,749 B2
(45) **Date of Patent: *Dec. 8, 2015**

(54) VARIABLE COMPRESSION RATIO SYSTEMS FOR OPPOSED-PISTON AND OTHER INTERNAL COMBUSTION ENGINES, AND RELATED METHODS OF MANUFACTURE AND USE

(71) Applicant: James M. Cleeves, Redwood City, CA (US)

(72) Inventor: James M. Cleeves, Redwood City, CA (US)

(73) Assignee: Pinnacle Engines, Inc., San Carlos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/858,790

(22) Filed: Apr. 8, 2013

(65) Prior Publication Data

US 2013/0220279 A1 Aug. 29, 2013

Related U.S. Application Data

(63) Continuation of application No. 13/269,541, filed on Oct. 7, 2011, now Pat. No. 8,413,619.

(60) Provisional application No. 61/391,530, filed on Oct. 8, 2010, provisional application No. 61/501,677, filed on Jun. 27, 2011, provisional application No. 61/511,521, filed on Jul. 25, 2011.

(51) Int. Cl.
*F02B 7/02* (2006.01)
*F02D 15/02* (2006.01)

(Continued)

(52) U.S. Cl.
CPC . *F02D 15/02* (2013.01); *F01B 7/02* (2013.01); *F01B 7/14* (2013.01); *F01L 1/3442* (2013.01);

(Continued)

(58) Field of Classification Search
CPC ..... F02D 15/02; F01B 7/14; F01B 7/02
USPC ..... 123/51 R–51 BD, 48 R–48 D, 78 R–78 F
See application file for complete search history.

(56) References Cited

U.S. PATENT DOCUMENTS 367,496 A 8/1887 Atkinson
1,082,004 A 12/1913 Anthony (Continued)

FOREIGN PATENT DOCUMENTS

CN 101427012 A 5/2009
DE 643470 C 4/1937

(Continued)

OTHER PUBLICATIONS

Extended European Search Report issued in European Application No. 11831731, mailed Oct. 9, 2014.

(Continued)

*Primary Examiner* — Lindsay Low
*Assistant Examiner* — Kevin Lathers
(74) *Attorney, Agent, or Firm* — Mintz Levin Cohn Ferris Glovsky and Popeo, P.C.

(57) ABSTRACT

Various embodiments of methods and systems for varying the compression ratio in opposed-piston engines are disclosed herein. In one embodiment, an opposed-piston engine can include a first phaser operably coupled to a first crankshaft and a second phaser operably coupled to a corresponding second crankshaft. The phase angle between the crankshafts can be changed to reduce or increase the compression ratio in the corresponding combustion chamber to optimize or at least improve engine performance under a given set of operating conditions.

19 Claims, 11 Drawing Sheets

(51) Int. Cl.

| | |
|---|---|
| ***F01B 7/14*** | (2006.01) |
| ***F01L 1/344*** | (2006.01) |
| ***F02B 75/28*** | (2006.01) |
| ***F02D 15/00*** | (2006.01) |
| ***F01B 7/02*** | (2006.01) |
| *F02B 75/04* | (2006.01) |
| *F01B 1/10* | (2006.01) |

(52) U.S. Cl.

CPC ..... *F02B 75/282* (2013.01); *F02D 15/00* (2013.01); *F01B 1/10* (2013.01); *F01L 2001/3443* (2013.01); *F01L 2001/34469* (2013.01); *F01L 2820/041* (2013.01); *F02B 75/042* (2013.01)

(56) References Cited

U.S. PATENT DOCUMENTS

| | | | | |
|---|---|---|---|---|
| 1,097,947 | A | | 5/1914 | Shaw |
| 1,140,987 | A | | 5/1915 | Kube |
| 1,258,524 | A | | 3/1918 | Berry |
| 1,316,977 | A | | 9/1919 | Ricardo |
| 1,377,798 | A | | 5/1921 | Berckenhoff |
| 1,453,304 | A | | 5/1923 | Charter |
| 1,459,819 | A | | 6/1923 | Bonner |
| 1,472,549 | A | | 10/1923 | Burtnett |
| 1,497,206 | A | | 6/1924 | Booton |
| 1,502,291 | A | | 7/1924 | Conway |
| 1,550,643 | A | | 8/1925 | Bullintgon |
| 1,634,768 | A | | 7/1927 | Bonner |
| 1,644,954 | A | | 10/1927 | Shearer |
| 1,673,340 | A | | 6/1928 | Schaeffer |
| 1,773,971 | A | | 8/1930 | Dunn |
| 1,812,323 | A | | 6/1931 | Davison et al. |
| 1,819,897 | A | | 8/1931 | Johnson |
| 1,823,770 | A | | 9/1931 | Tartrais |
| 1,837,870 | A | | 12/1931 | Johnston |
| 1,856,242 | A | | 5/1932 | D'Aix |
| 1,889,946 | A | | 12/1932 | Cadwell |
| 2,090,889 | A | | 8/1937 | Howald |
| 2,121,409 | A | | 6/1938 | Ricardo |
| 2,199,625 | A | | 5/1940 | Benno |
| 2,273,179 | A | | 2/1942 | Davison |
| 2,292,233 | A | | 8/1942 | Lysholm |
| 2,401,188 | A | * | 5/1946 | Prince ..... 123/48 B |
| 2,409,761 | A | | 10/1946 | Hulsing |
| 2,686,507 | A | | 8/1954 | Lombardi |
| 2,773,490 | A | | 12/1956 | Miller |
| 2,817,322 | A | | 12/1957 | Miller |
| 2,858,816 | A | | 11/1958 | Prentice |
| 2,937,631 | A | | 5/1960 | Coyle |
| 3,485,221 | A | | 12/1969 | Feedback |
| 3,533,429 | A | | 10/1970 | Shoulders |
| 3,780,719 | A | | 12/1973 | Weiertz |
| 3,948,241 | A | | 4/1976 | Melchior |
| 3,961,607 | A | * | 6/1976 | Brems ..... 123/78 R |
| 4,050,421 | A | | 9/1977 | Cendak |
| 4,057,040 | A | | 11/1977 | Wax |
| 4,104,995 | A | | 8/1978 | Steinbock |
| 4,516,537 | A | | 5/1985 | Nakahara et al. |
| 4,535,735 | A | | 8/1985 | Yoshinaga et al. |
| 4,815,421 | A | | 3/1989 | Paul et al. |
| 4,838,214 | A | | 6/1989 | Barrett |
| 4,856,463 | A | | 8/1989 | Johnston |
| 4,876,992 | A | * | 10/1989 | Sobotowski ..... 123/48 R |
| 4,928,658 | A | | 5/1990 | Ferrenberg et al. |
| 5,025,757 | A | | 6/1991 | Larsen |
| 5,054,438 | A | | 10/1991 | Takashima |
| 5,058,536 | A | | 10/1991 | Johnston |
| 5,113,805 | A | | 5/1992 | Kawamura |
| 5,127,375 | A | | 7/1992 | Bowman et al. |
| 5,188,067 | A | | 2/1993 | Fontichiaro et al. |
| 5,255,637 | A | | 10/1993 | Schechter |
| 5,445,117 | A | | 8/1995 | Mendler |
| 5,507,253 | A | | 4/1996 | Lowi, Jr. |
| 5,560,326 | A | | 10/1996 | Merritt |
| 5,623,894 | A | | 4/1997 | Clarke |
| 5,803,042 | A | | 9/1998 | Bortone |
| 6,039,011 | A | | 3/2000 | Agalarov et al. |
| 6,125,801 | A | | 10/2000 | Mendler |
| 6,205,963 | B1 | | 3/2001 | Davies |
| 6,230,671 | B1 | | 5/2001 | Achterberg |
| 6,230,683 | B1 | | 5/2001 | zur Loye et al. |
| 6,390,041 | B2 | | 5/2002 | Nakamura et al. |
| 6,474,281 | B1 | | 11/2002 | Walters |
| 6,502,543 | B1 | | 1/2003 | Arai et al. |
| 6,994,060 | B2 | * | 2/2006 | Yoeda ..... 123/90.11 |
| 7,004,119 | B2 | | 2/2006 | Dardalis |
| 7,559,298 | B2 | | 7/2009 | Cleeves |
| 7,584,724 | B2 | * | 9/2009 | Berger ..... 123/48 R |
| 7,921,817 | B2 | | 4/2011 | Cleeves |
| 8,210,147 | B2 | | 7/2012 | Cotton |
| 8,365,697 | B2 | | 2/2013 | Cleeves |
| 8,413,619 | B2 | | 4/2013 | Cleeves |
| 8,459,227 | B2 | | 6/2013 | Cotton |
| 8,573,178 | B2 | | 11/2013 | Cleeves |
| 8,651,086 | B2 | | 2/2014 | Cleeves |
| 8,789,499 | B2 | | 7/2014 | Alonso |
| 8,904,998 | B2 | | 12/2014 | Cleeves |
| 2004/0244758 | A1 | | 12/2004 | Weng et al. |
| 2008/0115771 | A1 | | 5/2008 | Elsbett |
| 2008/0127947 | A1 | | 6/2008 | Hofbauer et al. |
| 2009/0107139 | A1 | | 4/2009 | Berger |
| 2010/0147269 | A1 | | 6/2010 | Flowers et al. |
| 2012/0073526 | A1 | | 3/2012 | Dion et al. |
| 2012/0085302 | A1 | | 4/2012 | Cleeves |
| 2012/0089316 | A1 | | 4/2012 | Cleeves et al. |
| 2012/0158273 | A1 | | 6/2012 | Cleeves et al. |
| 2014/0000567 | A1 | | 1/2014 | Cleeves |
| 2014/0311431 | A1 | | 10/2014 | Cleeves |

FOREIGN PATENT DOCUMENTS

| | | | |
|---|---|---|---|
| DE | 19813398 | C1 | 9/1999 |
| DE | 10023442 | A1 | 11/2001 |
| EP | 1857801 | A1 | 11/2007 |
| FR | 348575 | A | 4/1905 |
| FR | 497282 | A | 12/1919 |
| FR | 805866 | A | 12/1936 |
| FR | 2900683 | A1 | 11/2007 |
| GB | 02015 | | 8/1909 |
| GB | 382670 | A | 10/1932 |
| GB | 542009 | A | 12/1941 |
| GB | 635664 | A | 4/1950 |
| GB | 746820 | A | 3/1956 |
| GB | 1466311 | A | 3/1977 |
| GB | 1516982 | A | 7/1978 |
| GB | 2431695 | A | 5/2007 |
| GB | 2432398 | A | 5/2007 |
| JP | 56-106040 | A | 8/1981 |
| JP | 62-007909 | | 1/1987 |
| JP | S63-154821 | | 6/1988 |
| JP | 01-313608 | | 12/1989 |
| JP | 09-280370 | | 10/1997 |
| JP | 10-038083 | | 2/1998 |
| JP | 10-311231 | A | 11/1998 |
| JP | 2001-073780 | A | 3/2001 |
| JP | 2004-239182 | A | 8/2004 |
| JP | 2005-113839 | A | 4/2005 |
| JP | 2008-505282 | A | 2/2008 |
| WO | WO-79/00650 | A1 | 9/1979 |
| WO | WO-2006/002982 | A1 | 1/2006 |
| WO | WO-2007/006469 | A2 | 1/2007 |
| WO | WO-2007/010186 | A1 | 1/2007 |
| WO | WO-2007/057660 | A1 | 5/2007 |
| WO | WO-2007/083159 | A1 | 7/2007 |
| WO | WO-2007/121086 | A2 | 10/2007 |

OTHER PUBLICATIONS

Heywood, John B., Internal Combustion Engine Fundamentals, Chapter 1—Engine Types and their Operation, Apr. 1988, p. 37, McGraw-Hill, Inc.

(56) References Cited

OTHER PUBLICATIONS

Heywood, John B., Internal Combustion Engine Fundamentals, Chapter 5—Ideal Models of Engine Cycles, Apr. 1988, pp. 170, 175, 184, and 185, McGraw-Hill, Inc.

Heywood, John B., Internal Combustion Engine Fundamentals, Chapter 9—Combustion in Spark-Ignition Engines, Apr. 1988, p. 393, McGraw-Hill, Inc.

Heywood, John B., Internal Combustion Engine Fundamentals, Chapter 12—Engine Heat Transfer, Apr. 1988, pp. A and B, McGraw-Hill, Inc.

Heywood, John. B., "Internal Combustion Engine Fundamentals", Ch. 13, Engine Friction and Lubrication, Apr. 1988, McGraw-Hill, Inc.

International Search Report dated Feb. 6, 2012 for PCT application No. PCT/US2011/055457.

International Search Report dated Mar. 19, 2012 for PCT application No. PCT/US2011/055486.

International PCT Search Report dated Jan. 23, 2014 for PCT application No. PCT/US2013/049160.

Law, Don et al., Controlled Combustion in an IC-Engine with Fully Variable Valve Train, Homogeneous Charge Compression Ignition (HCCI) Combustion—SP 1623, Mar. 2001, pp. 17-18, Society of Automotive Engineers, Inc., Warrendale, PA, USA.

Oakley, Aaron et al., Experimental Studies on Controlled Auto-Ignition (CAI) Combustion of Gasoline in a 4-stroke Engine, Homogeneous Charge Compression Ignition (HCCI) Combustion—SP 1623, Mar. 2001, pp. 105-109, Society of Automotive Engineers, Inc. Warrendale, PA, USA.

Rennie, Gabriele, Engine Shows Diesel Efficiency without the Emissions, Homogeneous Charge Compression Ignition Engine—Lawrence Livermore National Laboratory, S&TR Apr. 2004, pp. 17-19.

* cited by examiner

VARIABLE COMPRESSION RATIO SYSTEMS FOR OPPOSED-PISTON AND OTHER INTERNAL COMBUSTION ENGINES, AND RELATED METHODS OF MANUFACTURE AND USE

CROSS-REFERENCE TO RELATED PATENT APPLICATIONS INCORPORATED BY REFERENCE

The present application claims priority to and the benefit of U.S. Provisional Patent Application No. 61/511,521, filed Jul. 25, 2011, and entitled "VARIABLE COMPRESSION RATIO SYSTEMS FOR OPPOSED-PISTON AND OTHER INTERNAL COMBUSTION ENGINES, AND RELATED METHODS OF MANUFACTURE AND USE;" U.S. Provisional Patent Application No. 61/501,677, filed Jun. 27, 2011, and entitled "VARIABLE COMPRESSION RATIO SYSTEMS FOR OPPOSED-PISTON AND OTHER INTERNAL COMBUSTION ENGINES, AND RELATED METHODS OF MANUFACTURE AND USE;" and U.S. Provisional Patent Application No. 61/391,530, filed Oct. 8, 2010, and entitled "CONTROL OF INTERNAL COMBUSTION ENGINE COMBUSTION CONDITIONS AND EXHAUST EMISSIONS;" each of which is incorporated herein in its entirety by reference.

CROSS-REFERENCE TO PATENT APPLICATIONS INCORPORATED BY REFERENCE

U.S. Provisional Patent Application No. 61/391,476, filed Oct. 8, 2010, and entitled "INTERNAL COMBUSTION ENGINE VALVE ACTUATION AND ADJUSTABLE LIFT AND TIMING;" U.S. Provisional Patent Application No. 61/391,487, filed Oct. 8, 2010, and entitled "DIRECT INJECTION TECHNIQUES AND TANK ARCHITECTURES FOR INTERNAL COMBUSTION ENGINES USING PRESSURIZED FUELS;" U.S. Provisional Patent Application No. 61/391,502, filed Oct. 8, 2010, and entitled "CONTROL OF COMBUSTION MIXTURES AND VARIABILITY THEREOF WITH ENGINE LOAD;" U.S. Provisional Patent Application No. 61/391,519, filed Oct. 8, 2010, and entitled "IMPROVED INTERNAL COMBUSTION ENGINE VALVE SEALING;" U.S. Provisional Patent Application No. 61/391,525, filed Oct. 8, 2010, and entitled PISTON SLEEVE VALVE," U.S. Provisional Patent Application No. 61/498,481, filed Jun. 17, 2011, and entitled "POSITIVE CONTROL (DESMODROMIC) VALVE SYSTEMS FOR INTERNAL COMBUSTION ENGINES;" U.S. Provisional Patent Application No. 61/501,462, filed Jun. 27, 2011, and entitled "SINGLE PISTON SLEEVE VALVE WITH OPTIONAL VARIABLE COMPRESSION RATIO;" U.S. Provisional Patent Application No. 61/501,594, filed Jun. 27, 2011, entitled "ENHANCED EFFICIENCY AND NOX CONTROL BY MULTI-VARIABLE CONTROL OF ENGINE OPERATION;" and U.S. Provisional Patent Application No. 61/501,654, filed Jun. 27, 2011, and entitled "HIGH EFFICIENCY INTERNAL COMBUSTION ENGINE;" are incorporated herein by reference in their entireties.

U.S. Non-provisional patent application Ser. No. 13/271,096, filed Oct. 11, 2011, and entitled "ENGINE COMBUSTION CONDITION AND EMISSION CONTROLS;" U.S. Non-provisional patent application Ser. No. 12/478,622, filed Jun. 4, 2009, and entitled "INTERNAL COMBUSTION ENGINE;" U.S. Non-provisional patent application Ser. No. 12/624,276, filed Nov. 23, 2009, and entitled "INTERNAL COMBUSTION ENGINE WITH OPTIMAL BORE-TO-STROKE RATIO," U.S. Non-provisional patent application Ser. No. 12/710,248, filed Feb. 22, 2010, and entitled "SLEEVE VALVE ASSEMBLY;" U.S. Non-provisional patent application Ser. No. 12/720,457, filed Mar. 9, 2010, and entitled "MULTI-MODE HIGH EFFICIENCY INTERNAL COMBUSTION ENGINE;" and U.S. Non-provisional patent application Ser. No. 12/860,061, filed Aug. 20, 2010, and entitled "HIGH SWIRL ENGINE;" are also incorporated herein by reference in their entireties.

TECHNICAL FIELD

The present disclosure relates generally to the field of internal combustion engines and, more particularly, to methods and systems for varying compression ratio and/or other operating parameters of opposed-piston and other internal combustion engines.

BACKGROUND

There are numerous types of internal combustion engines in use today. Reciprocating piston internal combustion engines are very common in both two- and four-stroke configurations. Such engines can include one or more pistons reciprocating in individual cylinders arranged in a wide variety of different configurations, including "V", in-line, or horizontally-opposed configurations. The pistons are typically coupled to a crankshaft, and draw fuel/air mixture into the cylinder during a downward stroke and compress the fuel/air mixture during an upward stroke. The fuel/air mixture is ignited near the top of the piston stroke by a spark plug or other means, and the resulting combustion and expansion drives the piston downwardly, thereby transferring chemical energy of the fuel into mechanical work by the crankshaft.

As is well known, conventional reciprocating piston internal combustion engines have a number of limitations—not the least of which is that much of the chemical energy of the fuel is wasted in the forms of heat and friction. As a result, only about 25% of the fuel's energy in a typical car or motorcycle engine is actually converted into shaft work for moving the vehicle, generating electric power for accessories, etc.

Opposed-piston internal combustion engines can overcome some of the limitations of conventional reciprocating engines. Such engines typically include pairs of opposing pistons that reciprocate toward and away from each other in a common cylinder to decrease and increase the volume of the combustion chamber formed therebetween. Each piston of a given pair is coupled to a separate crankshaft, with the crankshafts typically coupled together by gears or other systems to provide a common driveline and control engine timing. Each pair of pistons defines a common combustion volume or cylinder, and engines can be composed of many such cylinders, with a crankshaft connected to more that one piston, depending on engine configuration. Such engines are disclosed in, for example, U.S. patent application Ser. No. 12/624,276, which is incorporated herein in its entirety by reference.

In contrast to conventional reciprocating engines which typically use reciprocating poppet valves to transfer fresh fuel and/or air into the combustion chamber and exhaust combustion products from the combustion chamber, some engines, including some opposed-piston engines, utilize sleeve valves for this purpose. The sleeve valve typically forms all or a portion of the cylinder wall. In some embodiments, the sleeve valve reciprocates back and forth along its axis to open and close intake and exhaust ports at appropriate times to introduce air or fuel/air mixture into the combustion chamber and exhaust combustion products from the chamber. In other embodiments, the sleeve valve can rotate about its axis to open and close the intake and exhaust ports.

Internal combustion engines are typically required to perform over a wide range of operating conditions. In most instances, however, the optimum geometric compression ratio in the combustion chamber is not the same for each operating condition. To the contrary, the optimum compression ratio often depends on engine load, valve timing, and other factors. Variable valve timing provides some flexibility to optimize or at least improve engine performance based on load, fuel, temperature, humidity, altitude and other operating conditions. Combining variable valve timing with variable compression ratio (VCR), however, can further reduce pumping work losses by reducing intake throttling and optimizing the expansion stroke for improved power and efficiency at a given engine operating condition.

While some systems for varying valve timing have overcome the issue of complexity, systems for varying compression ratio in, for example, conventional internal combustion engines are generally very complex and, as a result, have not been widely adopted. In the case of opposed-piston engines, many of these are diesel engines which may not realize significant benefits from variable compression ratio.

DETAILED DESCRIPTION

Figure 1:
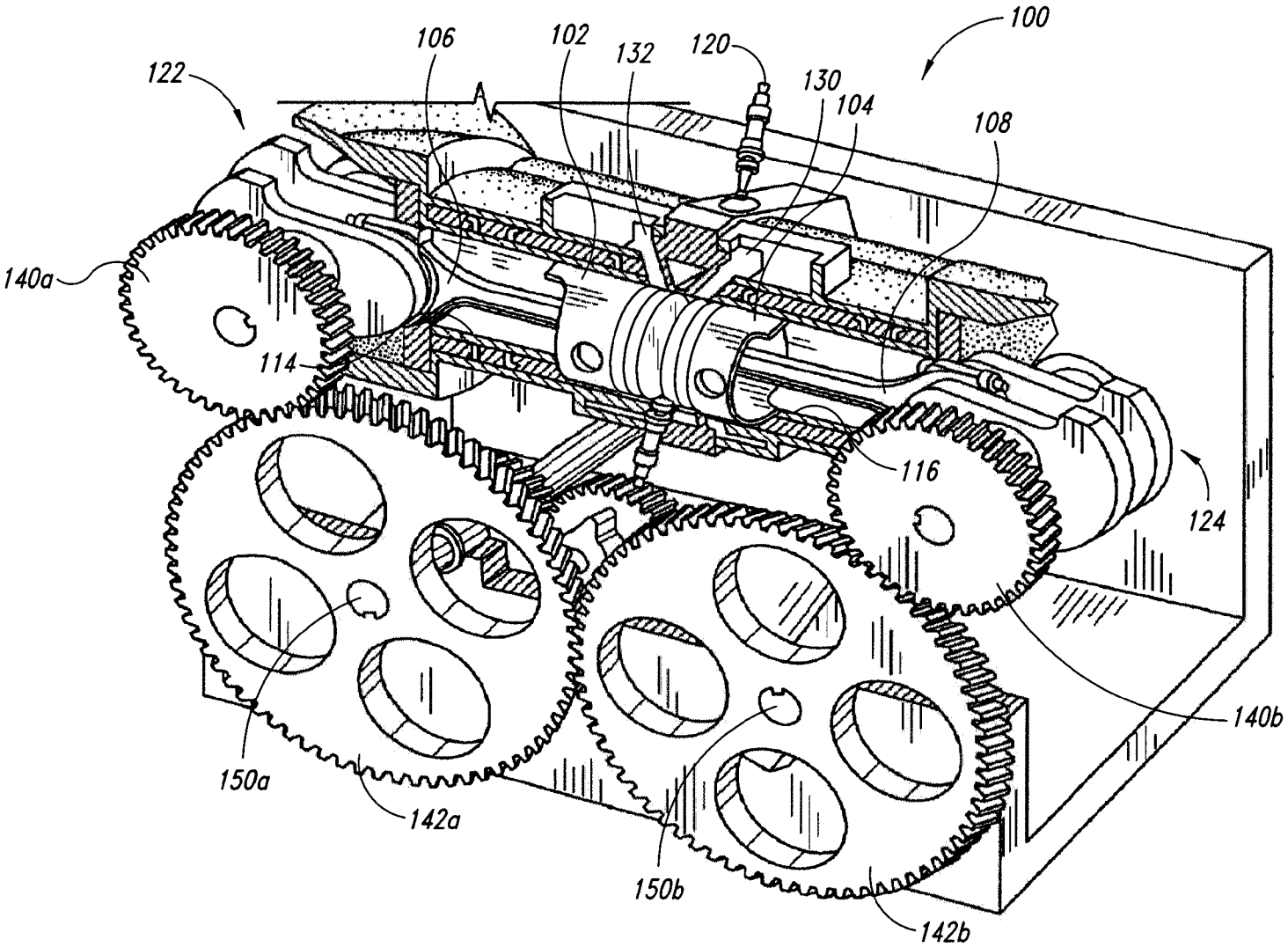
FIG. 1 is a partially cut-away isometric view of an internal combustion engine suitable for use with various embodiments of the present technology.

The following disclosure describes various embodiments of systems and methods for varying the compression ratio in opposed-piston and other internal combustion engines. Variable compression ratio can be employed in internal combustion engines to enable optimization or at least improvement of the thermodynamic cycle for the required operating conditions. In a spark ignited engine, for example, incorporating variable compression ratio capability enables the engine to operate more efficiently at light loads and more powerfully at relatively high loads.

In general, engine performance is linked to airflow through the combustion system. Airflow into the combustion chamber is dependent on both the flow characteristics of the various delivery passages and corresponding valve openings, as well as the timing of the valve opening and closing events. Modern engines can use variable valve timing to adjust some of the operating characteristics of the engine to a particular operating environment and performance demand. In conventional internal combustion engines (e.g., conventional reciprocating piston internal combustion engines), however, the internal volume of the combustion chamber versus crankshaft angle is a fixed relationship. As a result, variable compression ratio systems designed for use with such engines are typically very complex and, as a result, have not been widely implemented.

Changing the basic engine architecture, however, can overcome some of the basic complexity of variable compression ratio systems. For example, while conventional engines include a single piston in a single cylinder with a corresponding cylinder head, opposed-piston engines utilize two reciprocating pistons acting in a common cylinder. While originally developed to eliminate or reduce heat losses through the cylinder head by simply eliminating the cylinder head entirely, opposed-piston engines also lend themselves better to variable compression ratio systems than conventional internal combustion engines.

Traditionally, opposed-piston engines that employed variable crankshaft phasing to vary compression ratio were two-stroke engines that used port scavenging, eliminating the issue of camshaft timing relative to the crankshafts. Conversely, the advent of functional four-stroke opposed-piston engines necessitated new systems for variable crankshaft phasing to vary compression ratio in such engines. Embodiments of variable crankshaft phasing systems for use in opposed-piston engines, including four-stroke opposed-piston engines, are disclosed in, for example, in U.S. Non-provisional patent application Ser. No. 12/624,276, filed Nov. 23, 2009, and entitled "INTERNAL COMBUSTION ENGINE WITH OPTIMAL BORE-TO-STROKE RATIO," which is incorporated herein in its entirety by reference.

When two crankshafts are used in, for example, an opposed-piston engine, and the phase of one crankshaft is changed while the other remains unchanged relative to engine (e.g., valve) timing, the minimum volume positions of the crankshafts change relative to their original minimum volume positions. If, for example, the phase of a first crankshaft is advanced 20 degrees relative to the opposing second crankshaft, the position of minimum cylinder volume will occur at 10 degrees after TDC for the first crankshaft and 10 degrees before TDC for the second. Moreover, the advanced first crankshaft will be moving away from its physical TDC position as the retarded second crankshaft is moving toward its TDC position when the cylinder volume is at a minimum. If, however, it is desirable for the intake and exhaust valves to continue to operate at their original timing relative to the minimum combustion chamber volume (i.e., the "virtual TDC"), then the camshaft (or "cam") timing must also be changed to accommodate the change in crankshaft phase angle. More specifically, in the example above the camshaft would need to be retarded by 10 degrees relative to the advanced first crankshaft to maintain the same valve timing that existed before the phase angle of the first advanced crankshaft was changed.

As the foregoing example illustrates, if the phase of one crankshaft in an opposed-piston engine is changed (e.g., advanced) while the other remains unchanged relative to engine timing, then it will be necessary to change the timing of the associated camshaft(s) relative to the crankshafts to maintain constant cam timing relative to the conventional relationships of minimum and maximum combustion chamber volumes. Otherwise, simply incorporating phase change into a single crankshaft will likely lead to poorly optimized valve timing. In one aspect of the present technology, however, each crankshaft is associated with its own phase-changing device so that one crankshaft can be advanced while the other is retarded (by, e.g., an equivalent amount), thereby obviating the need to change camshaft timing relative to the crankshafts to maintain constant cam timing.

In one embodiment of the present technology, the compression ratio in an opposed-piston engine can be varied by changing the minimum distance between opposing pistons by means of two phasing devices ("phasers")—one associated with each crankshaft. In this embodiment, the first phaser can change (e.g., advance) the first crankshaft, while the second phaser can change (e.g., retard) the second crankshaft. At light loads, for example, the crankshafts can be in phase or nearly in phase so that the minimum distance between the pistons would be relatively small (leading to higher compression ratios). As a result, the primary balance of the engine at light loads can be relatively good. Conversely, at higher loads, the crankshafts can be moved more out of phase to increase the minimum distance between the pistons and thereby reduce the compression ratio. One consequence of increasing the phase angle, however, is that the primary balance may be sacrificed to a degree. But because higher loading operation is typically used less frequently than low load operation, the corresponding increase in engine vibration may be acceptable for short periods of time.

In some embodiments, the engine in the foregoing example can operate at higher compression ratios under light loads due to relatively low operating temperatures and low air/fuel mixture densities just prior to ignition. Resistance to knock and auto ignition is also relatively high under these conditions. Moreover, the relatively high expansion ratio that results from the higher compression ratio can extract more work out of the expanding hot combustion products than the lower expansion ratio associated with a lower compression ratio. Conversely, at higher power levels the compression ratio can be reduced to avoid or at least reduce engine knock. Although this also reduces the expansion ratio, the higher combustion pressures at the start of the expansion stroke do not dissipate as quickly and are available to provide higher torque during the expansion stroke.

In one aspect of the present technology, the crankshaft that takes the power out of the engine is referred to as the "master crankshaft" and it leads the "slave crankshaft" in an opposed-piston engine. Fixed phase engines of this type can have the master crankshaft lead the slave crankshaft to obtain proper timing of the airflow ports in the side of the cylinder wall (e.g., having the exhaust port open first in two-stroke configurations) and to minimize or at least reduce the torque transfer from the slave crankshaft to the master crankshaft. In the above example, for instance, the master crankshaft would lead the slave crankshaft by 20 degrees when the slave crankshaft piston was at its top-most position in the cylinder (i.e., TDC). At this point, the pressure on the top of the slave crankshaft piston would be aligned with the connecting rod and, accordingly, unable to impart any torque or at least any significant torque to the slave crankshaft. Conversely, the pressure on the opposing piston would be acting against a connecting rod that had much more angularity and leverage relative to the master crankshaft and, as a result, could impart significant torque to the master crankshaft. In this way, the average torque transmitted between the crankshafts is significantly reduced, which can minimize both wear and friction in the power train components.

In the opposed-piston engines described in the present disclosure and in the patent applications incorporated herein by reference, the cylinder walls (i.e., the sleeve valves) move in a manner that is the same as or at least very similar to poppet valve motion in a traditional four-stroke reciprocating internal combustion engine. More specifically, the intake sleeve valve is retracted from the center portion of the engine to expose an inlet port to the internal cylinder volume while the two pistons are moving back toward their bottom position. When the pistons are at or near their bottom positions, the inlet sleeve valve is pushed back towards its seat as the pistons start moving toward each other compressing the intake charge. The valve seal does not allow the high pressure intake charge to leak out of the cylinder, and therefore allows for either a diesel or spark ignited combustion followed by expansion of the combustion products. When the expansion is nearly complete and the pistons are again near the bottom of their travel, the exhaust sleeve valve is opened. The exhaust sleeve valve remains open, or at least near open, while the pistons return toward each other and decrease the internal volume of the combustion chamber to drive the exhaust out of the combustion chamber via a corresponding exhaust port. The exhaust sleeve valve then closes as the combustion chamber approaches its minimum volume, and the cycle repeats.

Adapting the opposed-piston style engine described above to include the embodiments of dual crankshaft phasing described herein provides the opportunity to optimize, or at least improve, the relationship between leading crankshaft and inlet sleeve valve positions. For example, because the piston crown on the inlet side could potentially block some of the flow through the inlet sleeve valve when the piston is near its top TDC position for some engine configurations, it is desirable for the inlet sleeve valve to be on the master or leading crankshaft side of the opposed-piston engine. In this way, the piston will lead the inlet sleeve valve on opening and avoid blocking the inlet port. Conversely, it may also be desirable to position the exhaust sleeve valve on the slave or lagging crankshaft side because the exhaust side piston will thereby arrive at its maximum extension (i.e., its TDC position) after the combustion chamber is at minimum volume and the exhaust valve has closed. This can provide minimum or at least reduced exhaust flow disruption by the exhaust side piston crown approaching the exhaust port during the valve closing event.

The opposed-piston sleeve valve engines described herein can be constructed with either a single cam to operate both intake and exhaust sleeve valves, or with dual cams (one for each valve). The twin cam arrangement can be such that the camshafts maintain a fixed relationship between each other, or, alternatively, the camshafts can also be phased relative to each other. Accordingly, a number of different crankshaft/camshaft configurations are possible including, for example: (1) One camshaft, two crankshafts, and two phasers; with one phaser on one or the other crankshaft and the other phaser on the camshaft. (2) One camshaft, two crankshafts, and two phasers; with one phaser on each crankshaft so that they can both be phased (e.g., one advancing, one lagging) relative to the camshaft. (3) Two camshafts, two crankshafts, and two phasers; with one phaser on each crankshaft so that they both can be appropriately phased (e.g., one lagging and one leading) relative to the two camshafts. (4) Two camshafts, two crankshafts, and three phasers; with one phaser on one of the crankshafts (e.g., the master crankshaft) and the remaining two phasers on each of the two camshafts, respectively.

One way that intake valve timing can be used with the opposed-piston engines described herein can be referred to as Late Intake Valve Closing or "LIVC." If the intake valve is left slightly open while the cylinder volume begins to decrease on the compression stroke, some of the intake charge may be pushed back into the inlet manifold. Although this may limit power out of the engine, it can have the positive effect of reducing the work required to draw the air (or the air/fuel mixture) across a throttle body upstream of the intake port. This characteristic can be useful for improving engine efficiencies at light loads. This valve timing arrangement can also result in reduced effective compression ratios and higher relative expansion ratios. Moreover, these effects can be combined with the crankshaft phasing compression ratio control systems and methods described above.

Late Exhaust Valve Closing ("LEVC") can be used to draw a portion of exhaust gas from the exhaust port back into the combustion chamber at the start of the intake stroke. This technique can provide a simplified exhaust gas recirculation system to improve emissions control and fuel efficiency.

Another example of a crankshaft/camshaft phasing configuration in accordance with the present technology includes: One or two camshafts, two crankshafts, and one phaser. In this example, the single phaser can be mounted on the master crankshaft to cause it to lead the slave crankshaft at low compression ratios. At these compression ratios, the camshaft can be configured for conventional opening and closing timings. At high compression ratios, the valve timing relative to the master crankshaft will result in an LIVC intake event and a similar late exhaust valve closing (LEVC). As a result, the late intake valve closing will effectively reduce the compression ratio while maintaining a relatively longer expansion ratio for engine efficiency. Moreover, late exhaust valve timing can ensure a long expansion ratio and that some of the exhaust gas is pulled back into the combustion chamber before the intake valve starts to open.

Certain details are set forth in the following description and in FIGS. 1-8 to provide a thorough understanding of various embodiments of the present technology. Other details describing well-known structures and systems often associated with internal combustion engines, opposed-piston engines, etc. have not been set forth in the following disclosure to avoid unnecessarily obscuring the description of the various embodiments of the technology.

Many of the details, relative dimensions, angles and other features shown in the Figures are merely illustrative of particular embodiments of the technology. Accordingly, other embodiments can have other details, dimensions, angles and features without departing from the spirit or scope of the present invention. In addition, those of ordinary skill in the art will appreciate that further embodiments of the invention can be practiced without several of the details described below.

In the Figures, identical reference numbers identify identical, or at least generally similar, elements. To facilitate the discussion of any particular element, the most significant digit or digits of any reference number refers to the Figure in which that element is first introduced. For example, element 130 is first introduced and discussed with reference to FIG. 1.

FIG. 1 is a partially cut-away isometric view of an internal combustion engine 100 having a pair of opposing pistons 102 and 104. For ease of reference, the pistons 102, 104 may be referred to herein as a first or left piston 102 and a second or right piston 104. Each of the pistons 102, 104 is operably coupled to a corresponding crankshaft 122, 124, respectively, by a corresponding connecting rod 106, 108, respectively. Each of the crankshafts 122, 124 is in turn operably coupled to a corresponding crankshaft gear 140*a*, 140*b*, respectively, and rotates about a fixed axis.

In operation, the pistons 102 and 104 reciprocate toward and away from each other in coaxially aligned cylinders formed by corresponding sleeve valves. More specifically, the left piston 102 reciprocates back and forth in a left or exhaust sleeve valve 114, while the right piston 104 reciprocates back and forth in a corresponding right or intake sleeve valve 116. As described in greater detail below, the sleeve valves 114, 116 can also reciprocate back and forth to open and close a corresponding inlet port 130 and a corresponding exhaust port 132, respectively, at appropriate times during the engine cycle.

In the illustrated embodiment, the left crankshaft 122 is operably coupled (e.g., synchronously coupled) to the right crankshaft 124 by a series of gears that synchronize or otherwise control piston motion. More specifically, in this embodiment the left crankshaft 122 is operably coupled to the right crankshaft 124 by a first camshaft gear 142*a* that operably engages the teeth on a second camshaft gear 142*b*. The camshaft gears 142 can fixedly coupled to corresponding central shafts 150*a, b* to drive one or more camshafts (not shown) for operation of the sleeve valves 114, 116. Various types of camshaft and/or valve actuation systems can be employed with the engine 100, including one or more of the positive control systems disclosed in U.S. Provisional Patent Application No. 61/498,481, filed Jun. 17, 2011, and entitled "POSITIVE CONTROL (DESMODROMIC) VALVE SYSTEMS FOR INTERNAL COMBUSTION ENGINES," which is incorporated herein in its entirety by reference. The camshaft gears 142 can include twice as many gear teeth as the corresponding crankshaft gears 140, so that the camshafts turn at half engine speed as is typical for four stroke engine operation.

Figure 2:
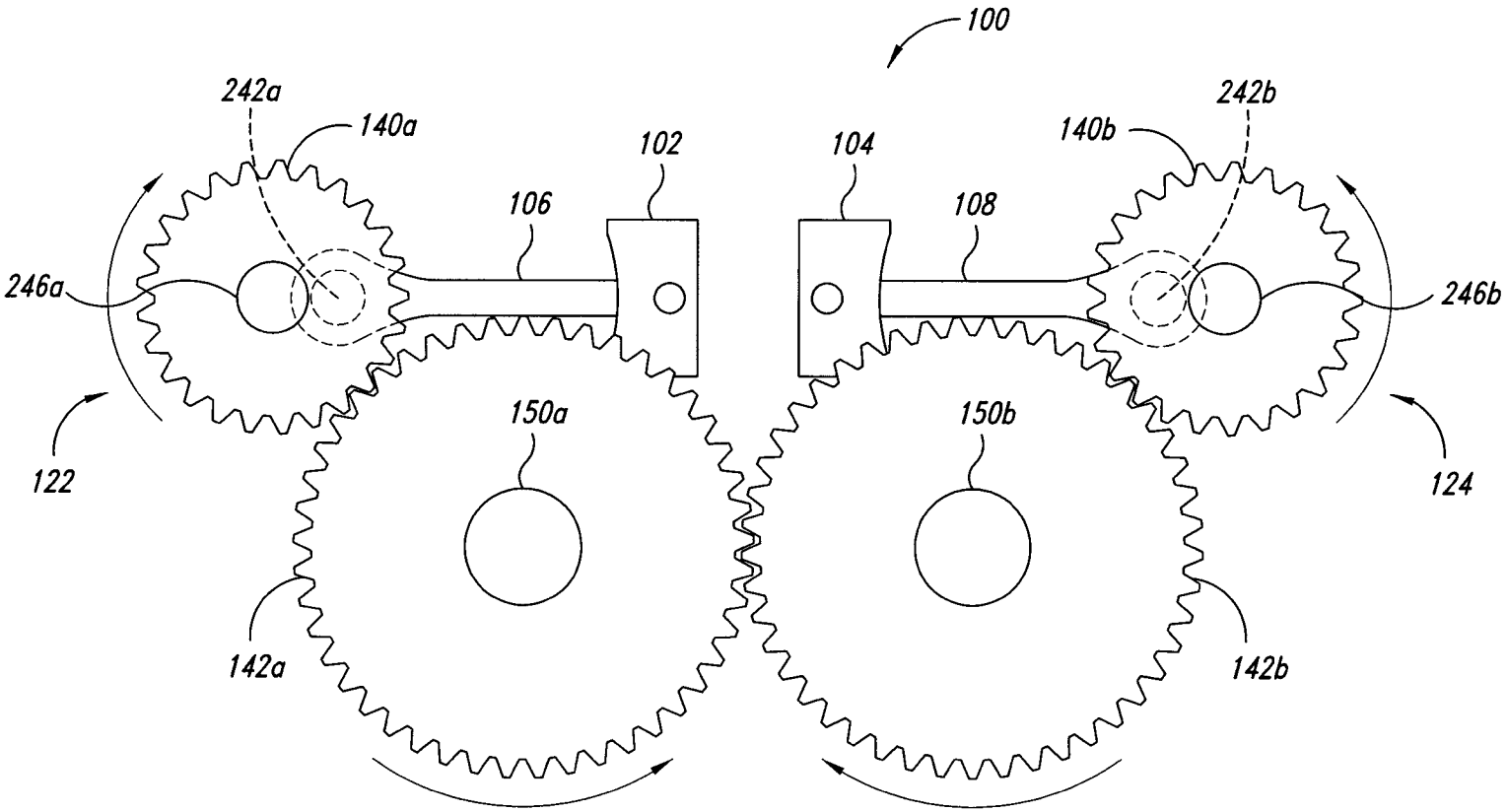
FIG. 2 is a partially schematic front view of the internal combustion engine of FIG. 1, illustrating the relationship between various components effecting the phasing and compression ratio of the engine in accordance with an embodiment of the present technology.

FIG. 2 is a partially schematic front view of the internal combustion engine 100 illustrating the relationship of various components that control engine timing in accordance with an embodiment of the present technology. A number of components and/or systems (e.g., sleeve valves, intake and exhaust tracks, etc.) have been omitted from FIG. 2 for purposes of clarity. As this view illustrates, each of the connecting rods 106, 108 is pivotally coupled to a rod journal 242 (Identified individually as a first rod journal 242*a* and a second rod journal 242*b*) on the corresponding crankshaft 122, 124, respectively. As with conventional crankshafts, the rod journals 242 are offset from main bearing journals 246 (Identified as a first main bearing journal 246*a* and a second main bearing journal 246*b*) which are aligned with the central axes of the crankshaft.

In the illustrated embodiment, the crankshafts 122 and 124 are phased so that the pistons 102 and 104 arrive at their top dead center (TDC) positions at the same time. Moreover, each of the crankshaft gears 140 is suitably meshed with the corresponding camshaft gear 142 to provide appropriate sleeve valve timing during engine operation. As described in greater detail below, however, the phasing of one or both of the crankshafts 122 and 124, and/or one or both of the camshafts 150 can be changed to alter a number of different operating parameters of the engine 100. For example, the crankshaft phasing and/or the valve phasing can be suitably changed to alter the compression ratio of the engine 100 as a function of load and/or other operating conditions.

Figure 3:
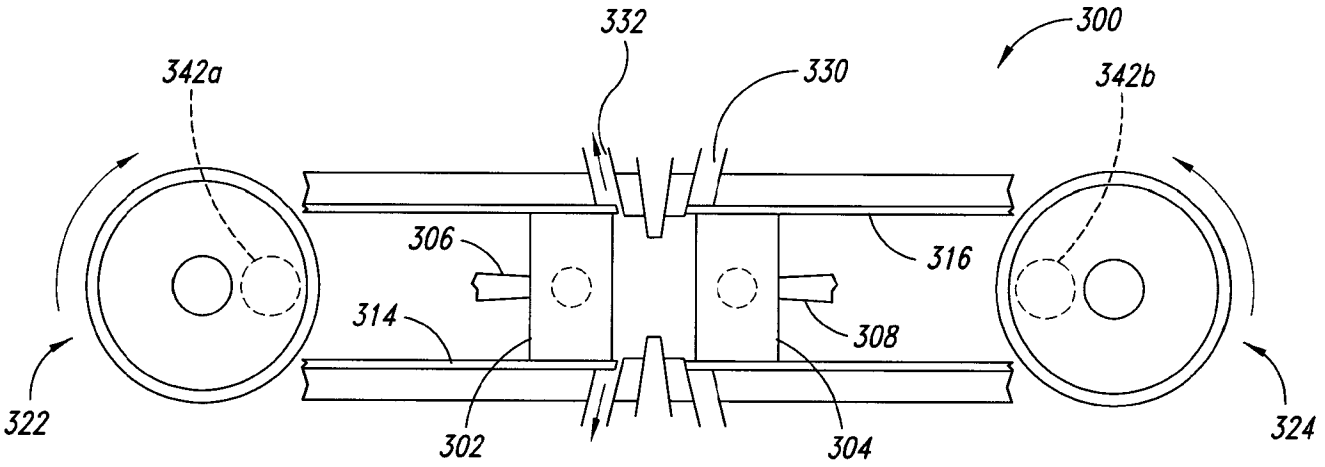
FIG. 3 is a partially schematic, cutaway front view of an opposed-piston engine having opposed crankshafts that are in phase with each other.

FIG. 3 is a partially schematic, cross-sectional front view of an engine 300 having opposing crankshafts that are in phase (i.e., the phase angle between the two periodic cycles of the two crankshafts is zero degrees, or at least very near zero degrees). Many of the components and features of the engine 300 are at least generally similar in structure and function to the engine 100 described in detail above with reference to FIGS. 1 and 2. For example, the engine 300 is an opposed-piston engine having a left or first piston 302 operably coupled to a first rod journal 342*a* on a first crankshaft 322, and a second piston 304 operably coupled to a second rod journal 342*b* on a right or second crankshaft 324.

In the illustrated embodiment, the pistons 302, 304 are at their TDC positions or "upper-most" positions on the exhaust stroke, and an exhaust sleeve valve 314 is nearing the closed position to seal off a corresponding exhaust port 332. In contrast, an intake sleeve valve 316 has been closed and sealing off an intake passage or port 330 that is in fluid communication with the combustion chamber for a substantial portion of the exhaust stroke. In this embodiment, the crankshafts 322, 324 are essentially "in phase," meaning that the pistons 302 and 304 both arrive at their respective TDC positions at the same time, or at least at approximately the same time.

As described in greater detail below, in some embodiments of the present technology the compression ratio can be varied by changing the phases of the crankshafts 322, 324 relative to each other. For example, the phase of the master crankshaft (i.e., the crankshaft that imparts the higher torque loads to the engine output shaft), can be shifted so that it leads the slave crankshaft (i.e., the crankshaft that transfers less torque to the output shaft), thereby reducing the torque transferred from one crankshaft to the other during engine operation. Reducing the torque transfer in this manner can minimize or at least reduce the power transmission losses as well as torque peaks that may need to be dampened to prevent resonance in the crankshaft connections.

FIGS. 4A-4F are a series of partially schematic, cross-sectional front views of an engine 400 for the purpose of illustrating some of the phasing technology discussed above. As with the engine 300 described above with reference to FIG. 3, the engine 400 includes opposed pistons 402 and 404 operably coupled to corresponding crankshafts 422 and 424, respectively, by corresponding rod journals 442*a* and 442*b*, respectively. The first piston 402 reciprocates back and forth in a bore of an exhaust sleeve valve 414 which in turn moves back and forth to open and close an exhaust passage or port 432 during engine operation. Similarly, the second piston 404 reciprocates back and forth in a bore of an intake sleeve valve 416 which opens and closes a corresponding intake port 430 during engine operation.

In the illustrated embodiment, however, the engine 400 includes a first phaser (not shown) associated with the first crankshaft 422 and a second phaser (also not shown) associated with the second crankshaft 424 to adjust the phasing (e.g., by retarding and advancing, respectively) of the respective crankshafts. For example, the second crankshaft 424 can be defined as the master crankshaft and is advanced from its TDC position by an angle A. The second crankshaft 422 can be defined as the slave crankshaft 422 and is retarded from its TDC position by an amount equal to, or at least approximately equal to, the angle A. As a result, the master crankshaft 424 leads the slave crankshaft 422 by a total phase angle of 2×A (e.g., if A is 30 degrees, then the master crankshaft 424 leads the slave crankshaft 422 by 60 degrees). In the foregoing example, the slave crankshaft 422 is associated with the exhaust valve 414, while the master crankshaft 424 is associated with the intake sleeve valve 416. In other embodiments of the present technology, however, the slave crankshaft 422 can be associated with the intake valve 416 and the master crankshaft 424 can be associated with the exhaust valve 414. Moreover, in many embodiments the valves 414 and 416 (or, more specifically, the associated camshaft or camshafts) can be phased independently and/or differently than the crankshafts 422 and 424.

Figure 4A:
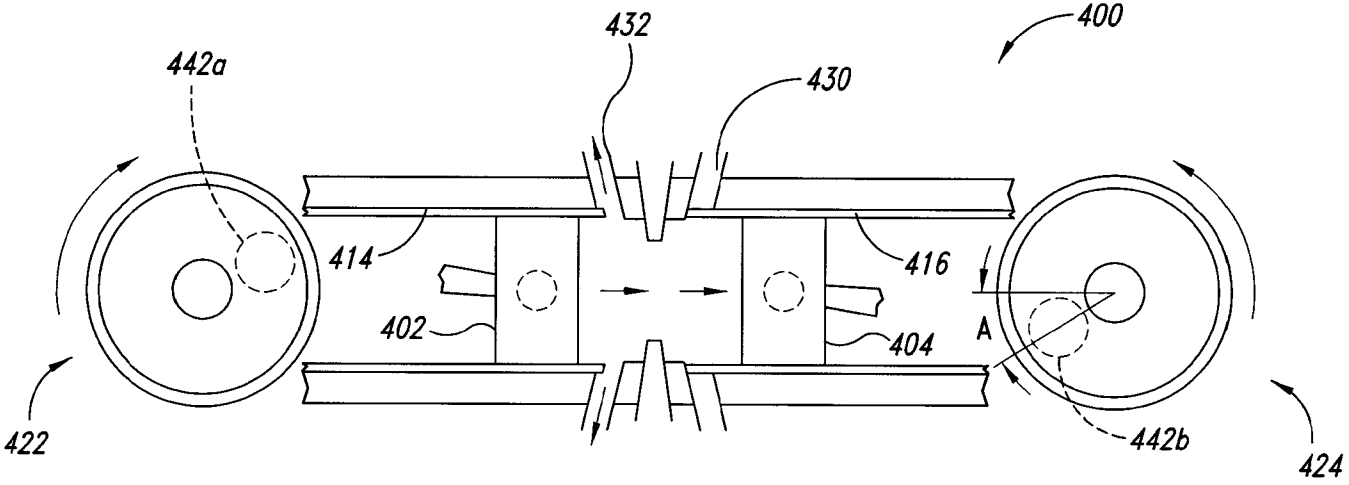
FIGS. 4A-4F are a series of partially schematic, cutaway front views of an opposed-piston engine having crankshaft phasing in accordance with an embodiment of the present technology.

FIG. 4A illustrates the first piston 402 as it closely approaches its TDC position on the exhaust stroke, while the second position 404 has just begun moving away from its TDC position. As a result, the intake/master side piston 404 is starting "down" its bore before the intake valve 416 has begun to open, resulting in less potential interference between the crown of the piston 404 and the leading edge of the intake valve 416 proximate the intake port 430. Moreover, the friction of the piston 404 moving from left to right compliments the opening motion of the intake valve 416. The exhaust/slave side piston 402 lags the exhaust valve 414, so that the piston 402 is still part way down the bore and moving toward the TDC position as the exhaust valve 414 continues closing. This keeps the crown of the piston 402 away from the leading edge of the exhaust valve 414 as it closes, reducing the likelihood for interference while the frictional force of the moving piston 402 facilitates the right to left closing motion of the exhaust valve 414.

Accordingly, the engine 400 includes a first phaser associated with the first crankshaft 422 and a second phaser associated with the second crankshaft 424 to individually adjust the phasing of the two crankshafts. In contrast, if only one phaser were included for adjusting the phase of a single crankshaft while the other crankshaft phase remained unchanged, then the valve timing would also have to be adjusted to maintain constant valve timing. For example, if only the master crankshaft was adjusted by, for example, being advanced 20 degrees relative to the slave crankshaft to reduce the compression ratio, then the minimum combustion chamber volume (e.g., the "effective TDC" for the engine cycle) would occur when the slave crankshaft was at 10 degrees before the top of its stroke and the master crankshaft was at 10 degrees after the top of its stroke. Accordingly, if the intake valve were expected to start opening at the effective TDC, then the timing of the intake valve would have to be changed relative to both crankshafts. More specifically, the timing of the intake valve (and, for that matter, the exhaust valve) would have to be advanced by 10 degrees to maintain the same valve timing that occurred prior to advancing the master crankshaft by 20 degrees.

In contrast to a system in which only a single crankshaft phase is changed, by utilizing a phaser with each crankshaft as disclosed herein, the phaser associated with the master crankshaft can advance the master crankshaft 10 degrees ahead of the intake cam, and the phaser associated with the slave crankshaft can phase the slave crankshaft to lag the exhaust cam by 10 degrees. As a result, the timing of the intake cam and the exhaust cam would stay at a fixed relationship relative to each other and to the minimum chamber volume. By way of example, referring to the engine 100 described above with reference to FIG. 2, a first phaser associated with the left crankshaft 122 could retard the left crankshaft 122, while a second phaser associated with the right crankshaft 124 could advance the right crankshaft by an equivalent amount. Doing so would not alter the timing of the camshafts 150 driven by the respective cam gears 142. Accordingly, the use of two phasers can simplify a variable compression ratio system for an opposed-piston internal combustion engine. Although the multiple phaser system described above is described in the context of a gear connection between the respective crankshafts and camshafts, the system works equally well with chain, belt drive, and/or other suitable connections between the respective crankshafts and camshafts.

Figures 4B, 4C, 4D:
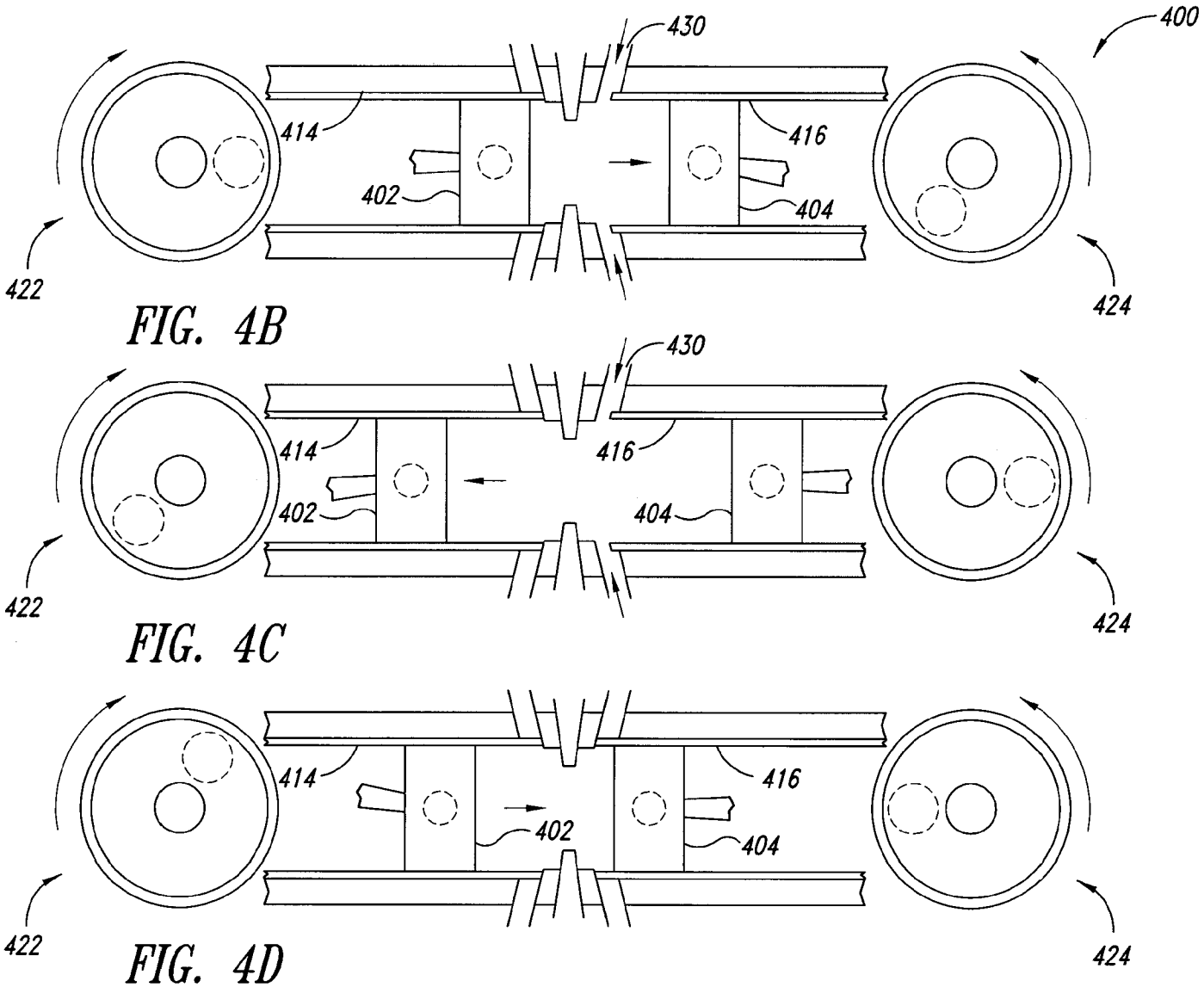

Referring next to FIG. 4B, as the crankshafts 422, 424 continue rotating, the first piston 402 reaches its physical top position (i.e., its TDC position) where it momentarily stops, while the second piston 404 is moving down the cylinder at a substantial pace. At this time, the intake sleeve valve 416 approaches the fully open position to draw air or an air/fuel mixture into the combustion chamber. As mentioned above, leading the intake valve in this manner enables the piston 404 to impart a frictional load on the intake valve 416 that facilitates valve opening, while precluding interference between the piston crown and the intake port 430.

In FIG. 4C, the master crankshaft 424 is at the bottom dead center ("BDC") position and the second piston 404 is momentarily stopped. At this time, the intake sleeve valve 416 is moving from right to left toward the closed position. The first piston 402, however, is still moving from right to left toward its BDC position and continues to draw air or an air/fuel mixture into the combustion chamber through the partially open intake port 430.

As shown in FIG. 4D, as the master crankshaft 424 approaches the TDC position, the second piston 404 is again momentarily stopped and the intake valve 416 is fully closed, as is the exhaust sleeve valve 414. In contrast, the first piston 402 is continuing to move from left to right and compress the intake charge in the combustion chamber.

Figure 4E:
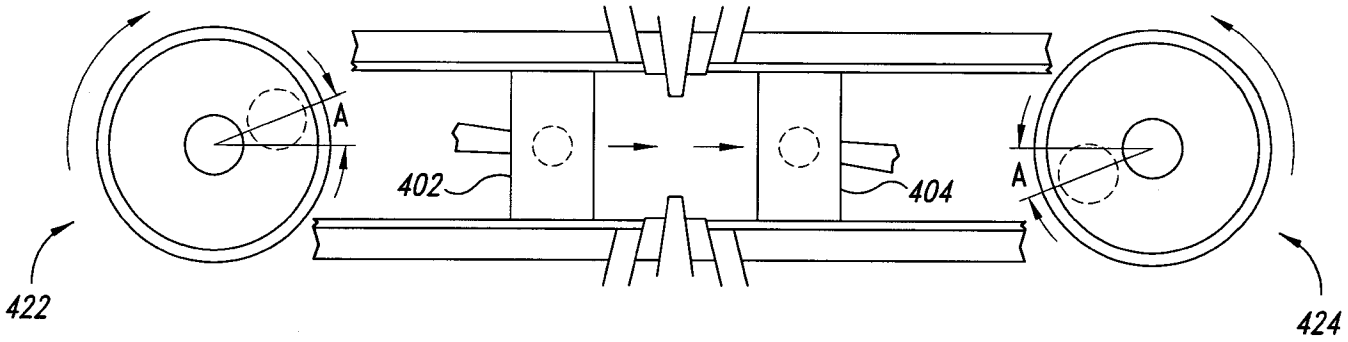

As shown in FIG. 4E, the first piston 402 and the second piston 404 are closest to each other when the slave crankshaft 422 is at the angle A before TDC and the master crankshaft 424 is at the angle A after TDC. This position also corresponds to the maximum compression of the intake charge. As should be clear by comparison of FIG. 3 to FIG. 4E, the total volume of the combustion chamber increases by phasing the crankshafts and, as a result, phased crankshafts result in lower compression ratios. Although the piston position shown in FIG. 4E corresponds to maximum compression of the intake charge, igniting the charge at or near this time could lead to inefficiencies because the first piston 402 would be driving against the contrary motion of the slave crankshaft 422. Accordingly, in one aspect of the present technology, intake charge ignition can be forestalled until the phased crankshafts 422 and 424 are in the subsequent positions shown in FIG. 4F.

Figure 4F:
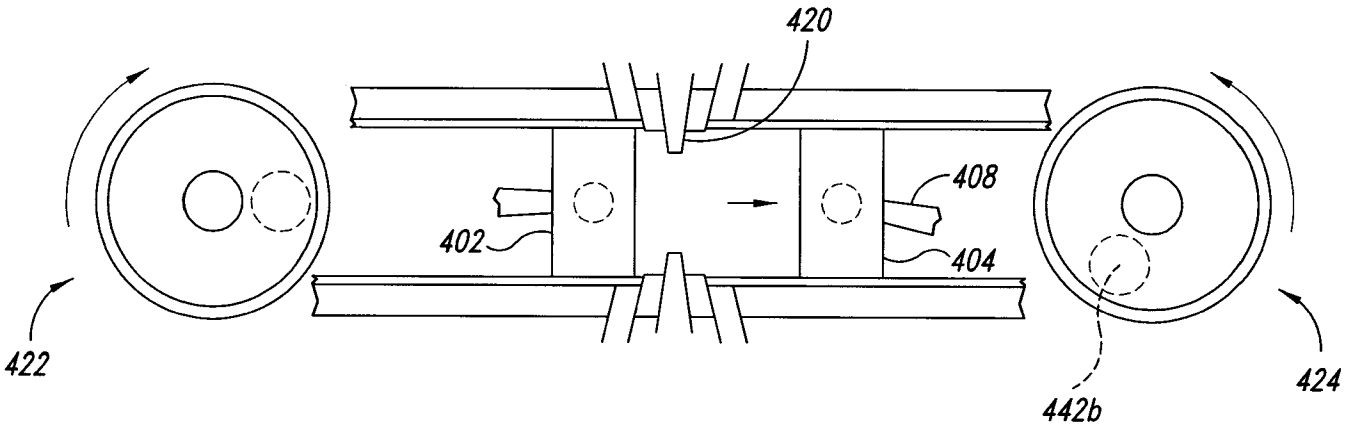

As shown in FIG. 4F, one or more spark plugs 420 or other ignition sources can be used to ignite the intake charge when the slave crankshaft 422 is at the TDC position with the first piston 402 momentarily stopped, and the second piston 404 is partially down the cylinder and moving towards its BDC position. In this manner, the combustion force applies a greater torque to the master crankshaft 424 because of the offset angle and leverage between the connecting rod 408 and corresponding rod journal 442*b*. This crankshaft phasing arrangement reduces the torque transferred from the slave crankshaft 422 to the master crankshaft 424 and also helps reduce power transmission losses as well as torque peaks that may cause resonance in the driveline.

The foregoing discussion illustrates one embodiment of crankshaft phasing to vary compression ratio in opposed-piston engines without having to alter valve timing. In other embodiments, however, valve timing can also be adjusted with compression ratio to provide desirable characteristics by implementing one or more phasers to control operation of one or more camshafts. Moreover, although FIGS. 4A-4F and the related discussion above describe operation of a four stroke, opposed-piston engine (i.e., an engine in which the pistons perform four strokes per engine cycle: intake, compression, power, and exhaust), other embodiments of the methods and systems disclosed herein can be implemented with two stroke engines (i.e., an engine in which the pistons perform two strokes per engine cycle: intake/compression and combustion/exhaust).

Figure 5A:
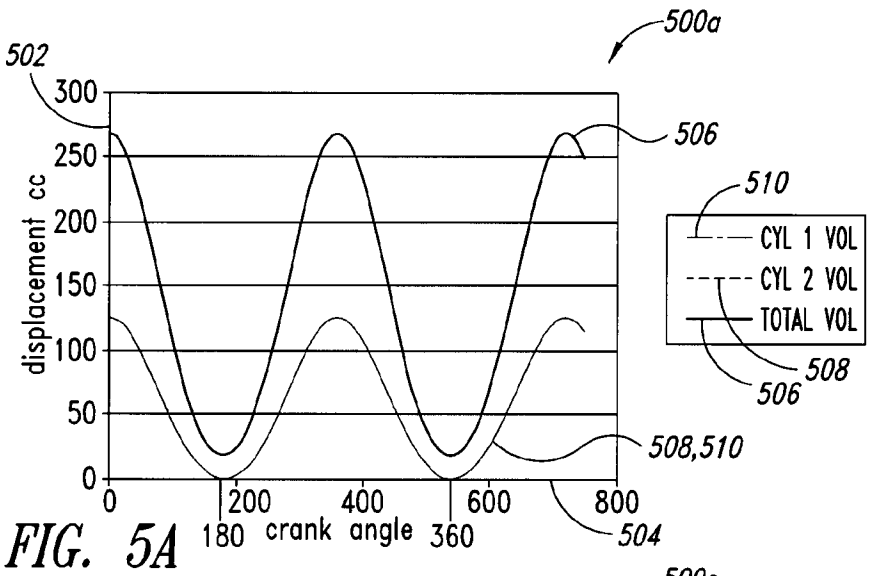
FIGS. 5A-5D are a series of graphs illustrating the relationship between crankshaft phasing and cylinder displacement in accordance with various aspects of the present technology.

FIGS. 5A-5D include a series of graphs 500*a-d*, respectively, illustrating piston positions and effective cylinder displacements as a function of crankshaft angle for various embodiments of the phased crankshaft, opposed-piston engines described in detail above. Referring first to FIG. 5A, the first graph 500*a* measures cylinder displacement in cubic centimeters (cc) along a vertical axis 502, and crankshaft angle in degrees along a horizontal axis 504. A first plot line 510 describes the path or periodic cycle of a first piston, such as the piston 402 shown in FIGS. 4A-4F, and a second plot line 508 describes the path or periodic cycle of an opposing second piston, such as the piston 404. As the graph 500*a* illustrates, in the embodiment of FIG. 5A the timing of the first piston and the timing of the second piston are the same. In addition, the periodic cycles of the two pistons have the same period. A third plot line 506 illustrates the change in the total chamber volume as a function of crankshaft angle. In FIG. 5A, the two crankshafts are in phase (i.e., there is zero degrees phasing or phase angle between the crankshafts), resulting in, e.g., a 250 cc cylinder displacement for a maximum effective compression ratio of 15:1 with a minimum combustion chamber volume occurring at 180 degrees (i.e., when both crankshafts are at TDC).

Figure 5B:
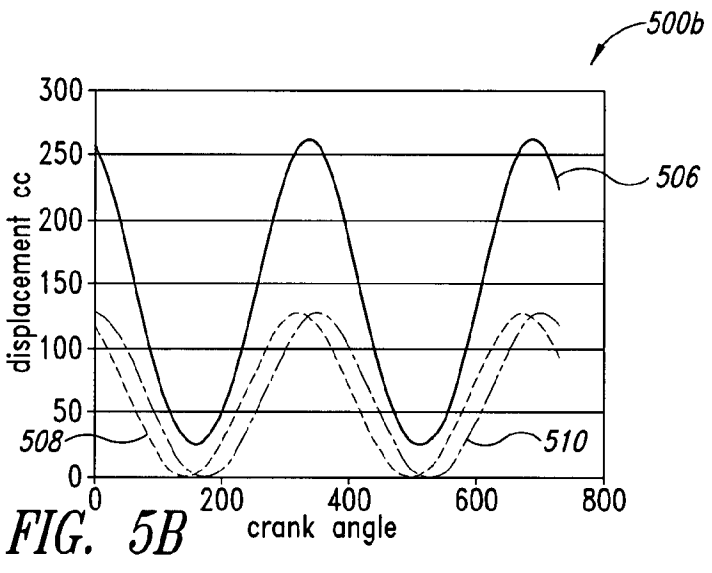

Turning next to FIG. 5B, in the second graph 500*b* the periodic cycles of the two pistons (and, accordingly, the two crankshafts) remains the same, but the timing of the first piston and the second piston (i.e., the relative positions of the two pistons at any given time) changes. More specifically, in this embodiment the second piston as shown by the second plot line 508 leads the first piston as shown by the first plot line 510 by a phase angle of 30 degrees. Although the displacement of each individual piston does not change, the total cylinder displacement is reduced to 241 ccs as shown by the third plot line 506. More specifically, the distance between the peaks and valleys of the third plot line 506 represent 241 ccs, in contrast to the 250 ccs represented by the peak-to-valley distance of the third plot line 506 in the first graph 500*a*. Moreover, phasing the crankshafts (and, accordingly, the corresponding pistons) as shown in the second graph 500*b* by 30 degrees results in a 12.5:1 effective compression ratio because of the reduced cylinder displacement and increased "closest" distance between pistons. Additionally, the minimum combustion chamber volume no longer occurs at 180 degrees, but instead occurs at 165 (i.e., 15 degrees before TDC of, e.g., the first piston). Put another way, in this embodiment the minimum combustion chamber volume "lags" the master crankshaft (e.g., the crankshaft coupled to the second piston shown by line 508) by one half the angle (e.g., one half of 30 degrees, or 15 degrees) that the slave crankshaft lags the master crankshaft.

Figure 5C:
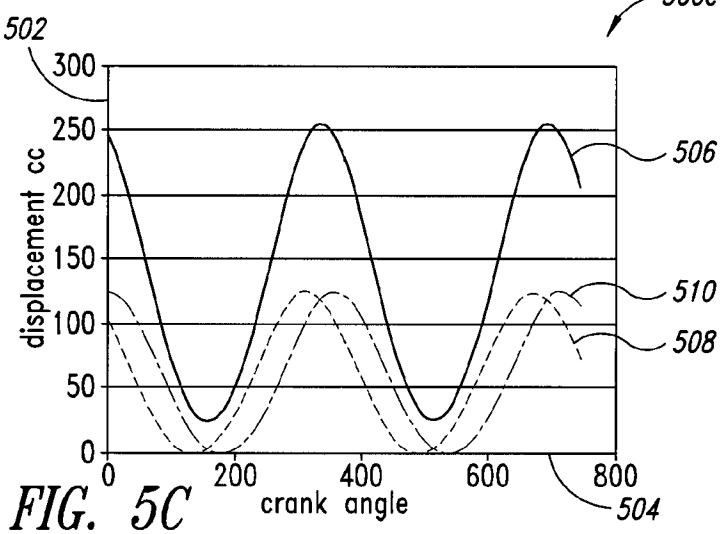
Figure 5D:
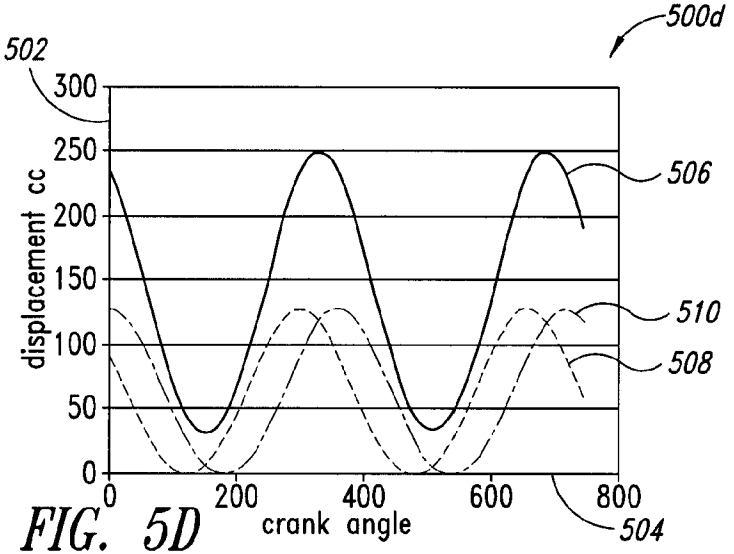

Increasing the phase angle between the crankshafts will accordingly decrease the effective compression ratio, as shown by the third graph 500*c* of FIG. 5C. Here, there is 45 degree phasing between the respective crankshafts, which further reduces the effective compression ratio to 10.2:1 with a corresponding cylinder displacement reduction to 231 ccs. As shown in FIG. 5D, further increasing the phasing between crankshafts to 60 degrees further reduces the cylinder displacement to 216 ccs, with a corresponding reduction in effective compression ratio to 8:1.

As illustrated by FIGS. 5A-5D, increasing the phase angle between the two crankshafts from 0 degrees to 60 degrees reduces the corresponding compression ratio from 15:1 to 8:1 for the particular engine configuration used in these examples. The range of variable compression ratio, however, can be altered by changing the initial set up conditions of the engine. For example, in another engine configuration the same phase change of 60 degrees could result in a reduction in compression ratio of from 20:1 to 9.3:1, with the minimum combustion chamber volume occurring at the same location for each configuration. Accordingly, the compression ratio range can be altered by changing the initial operating conditions (e.g., the initial compression ratio) of a particular engine.

Figure 6B:
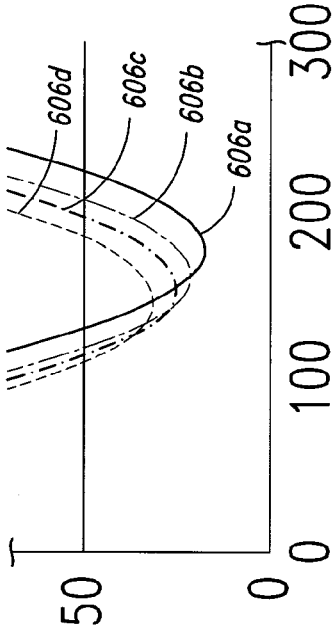
FIG. 6B is an enlarged portion of the graph of FIG. 6A.
Figure 6A:
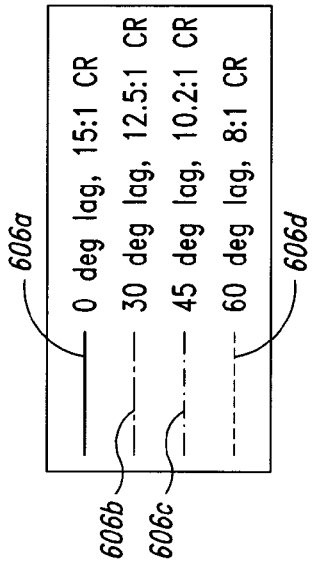
FIG. 6A is a graph illustrating the relationship between cylinder volume and crankshaft angle in accordance with another embodiment of the present technology.
Figure 6A:
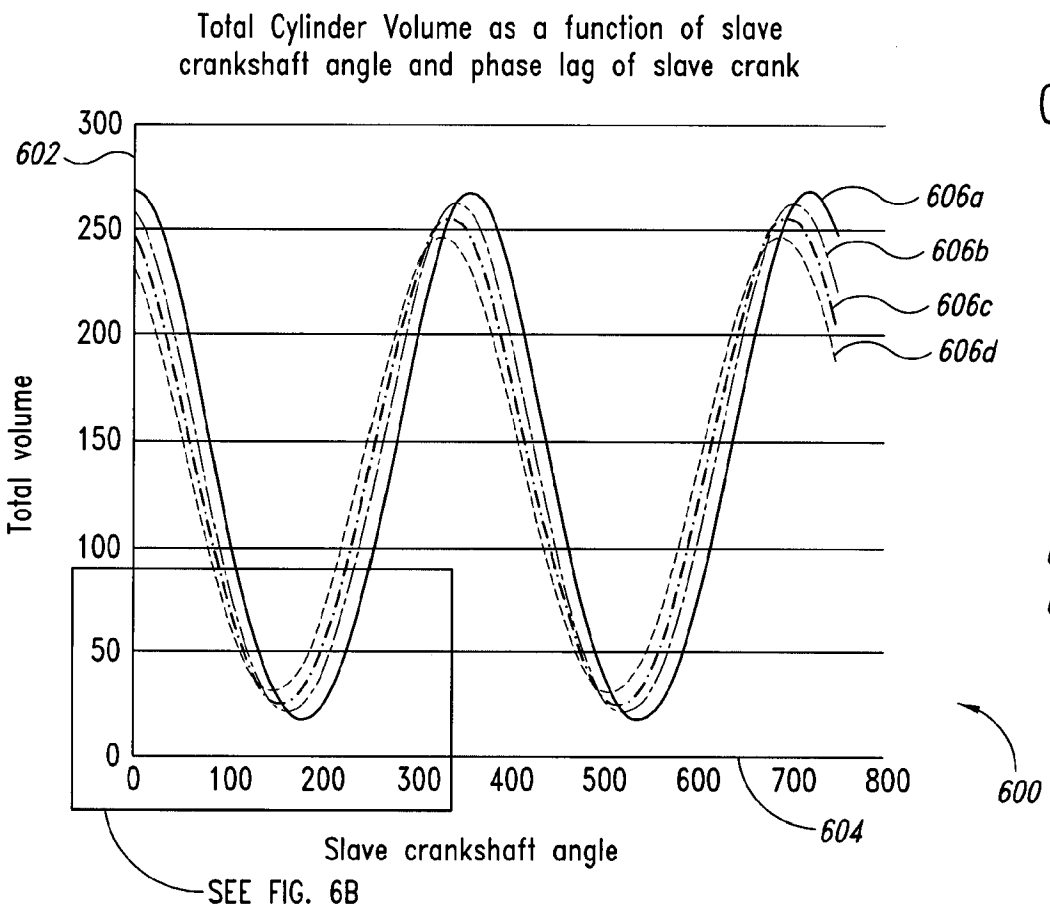

FIG. 6A is a graph 600 illustrating total cylinder volume as a function of crankshaft phase angle for an opposed-piston engine, and FIG. 6B is an enlarged view of a portion of the graph 600. As discussed above with reference to FIGS. 5A-5D, the total cylinder displacement decreases as the phase angle between crankshafts increases. This is illustrated by a first plot line 606*a*, which shows that the total displacement with 0 degrees lag of the slave crankshaft has the highest displacement (e.g., 250 ccs) and the correspondingly highest compression ratio 15:1. When the slave crankshaft lags the master crankshaft by 30 degrees, the cylinder displacement incrementally decreases as does the compression ratio (e.g., 241 ccs and 12.5:1, respectively) as illustrated by a second plot line 606*b*. In this example, a maximum phase lag of 60 degrees, as represented by a fourth plot line 606*d*, results in the lowest compression ratio of 8:1 and a corresponding lowest displacement of 216 ccs. As the foregoing discussion illustrates, an active phase change system as described herein can be used to efficiently reduce (or increase) the compression ratio of an opposed-piston engine to best fit the particular operating conditions (e.g., light loads, high loads, fuel, etc.) of an engine. There are a number of different phasing devices that can be used to actively vary the phase angle of crankshafts (and/or camshafts) in the manner described above.

Figure 7A:
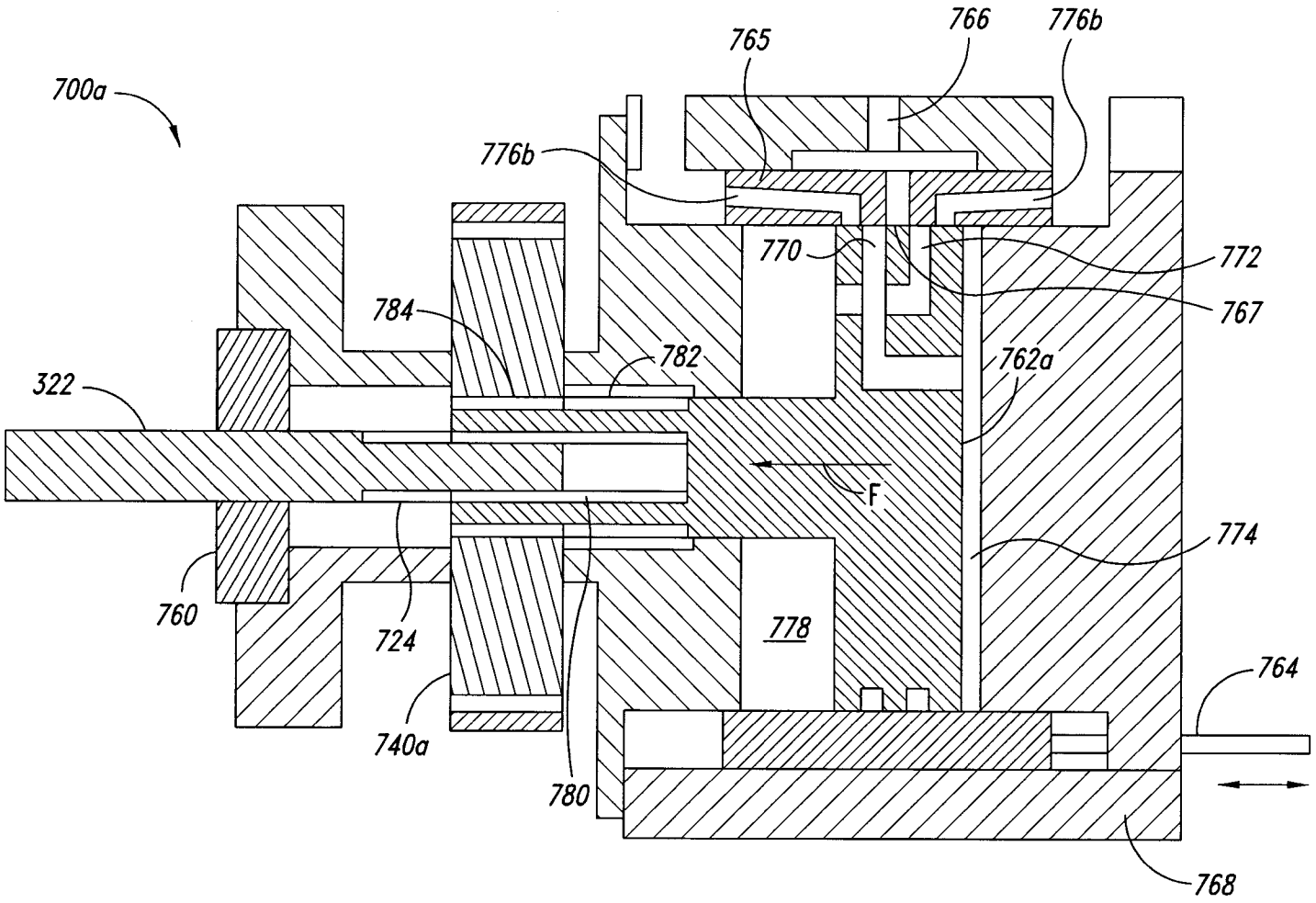
FIGS. 7A-7C are a series of cross-sectional side views of phasers configured in accordance with embodiments of the present technology.

FIG. 7A is a partially schematic, cross sectional side view of a phase change assembly or "phaser" 700*a* configured in accordance with an embodiment of the present technology. The phaser 700*a* can be operably coupled to a master crankshaft and a slave crankshaft (one per crankshaft) to provide the dual crankshaft phasing features described in detail above. The phaser 700*a* can also be coupled to a single crankshaft for single phasing, and/or to one or more camshafts.

In the illustrated embodiment, the phaser 700*a* includes a phasing head 762*a* that is operably coupled to a distal end of a crankshaft (e.g., the first or slave crankshaft 322 described above with reference to FIG. 3). More specifically, in the illustrated embodiment an end portion of the crankshaft 322 includes a plurality of (e.g.) left hand helical splines or gear teeth 724 on an outer surface thereof which engage complimentary or matching left hand helical gear teeth 780 on an internal surface of a central portion of the phasing head 762*a*. In addition, right hand helical gear teeth 782 can be provided on an adjacent outer surface of the phasing head 762*a* to engage matching right hand helical gear teeth 784 on a crankshaft drive member, such as a crankshaft gear 740*a*. The phasing head 762*a* is free to move fore and aft relative to a cylindrical valve body 765 in a hydraulic fluid (e.g., oil) cavity having a front side volume 774 and a back side volume 778. The phasing head 762*a* includes a first oil passage 770 leading from an outer surface to the front side volume 774, and a second oil passage 772 leading from the outer surface to the back side volume 778. The valve body 765 can flow oil from an oil supply 766 into the phasing head cavity via a supply passage 767. The valve body 765 also includes a first outflow passage 776*a* and a second outflow passage 776*d*.

To operate the phaser 700*a*, an actuator 764 is moved in a desired direction (e.g., in a forward direction F) to move the valve body 765 in the same direction. When the valve body 765 moves forward in the direction F a sufficient amount, the oil supply passage 767 aligns with the first oil passage 770. Oil from the oil supply 766 then flows through the first oil passage 770 and into the front side volume 774, driving the phasing head 762*a* in the direction F. As the phasing head 762*a* moves from right to left, oil in the back side volume 778 escapes via the second oil passage 772, which instead of being blocked by the valve body 765 is now in fluid communication with the first outflow passage 776*a*.

In the illustrated embodiment, an adjacent portion of a crankcase 768 and the valve body 765 and do not rotate with the crankshaft 322. However, the phasing head 762*a* and the crankshaft gear 740*a* do rotate with the crankshaft 322. As the phasing head 762*a* moves from right to left in the direction F, the relative motion between the left hand helical gear teeth 780 on the internal bore of the phasing head 762*a* and the engaging teeth 734 on the crankshaft 322 causes the crankshaft 322 to rotate relative to the phasing head 762*a*. Moreover, the relative motion between the right hand helical gear teeth 782 on the outer surface of the phasing head 762*a* and the engaging teeth 784 on the internal bore of the crankshaft gear 740*a* causes the crankshaft gear 740*a* to rotate in the opposite direction relative to the phasing head 762*a* and, accordingly, the crankshaft 322. As a result, movement of the phasing head 762*a* causes the operational angle between the crankshaft gear 740*a* and the crankshaft 322 to change in proportion to the movement of the phasing head 762*a*.

To reduce the phase angle in this example, the actuator 764 can be moved in the direction opposite to the direction F to slide the valve body 765 from left to right relative to the phasing head 762*a*. Doing so aligns the oil supply passage 767 with the second oil passage 772 in the phasing head 762, which directs pressurized oil into the back side volume 778. The pressurized oil flowing into this volume drives the phasing head 762 from left to right in the direction opposite to the direction F, thereby reducing the phase angle between the crankshaft gear 740*a* and the crankshaft 322. As the phasing head 762*a* moves from left to right, the oil in the front side volume 774 escapes through the phasing head 762*a* via the first passage 770 which is now aligned with the second outflow passage 776*b*. In the embodiment described above with reference to FIG. 7A, the crankshaft gear 740*a* (which could also be a pulley, sprocket, etc.) is held in a horizontally fixed position relative to the crankcase 768 and, accordingly, is held in a horizontally fixed relationship relative to the gear (or belt, chain, etc.; not shown) it engages to drive a corresponding camshaft (and/or other device such as an ignition device, oil/water pump, etc).

Figure 7B:
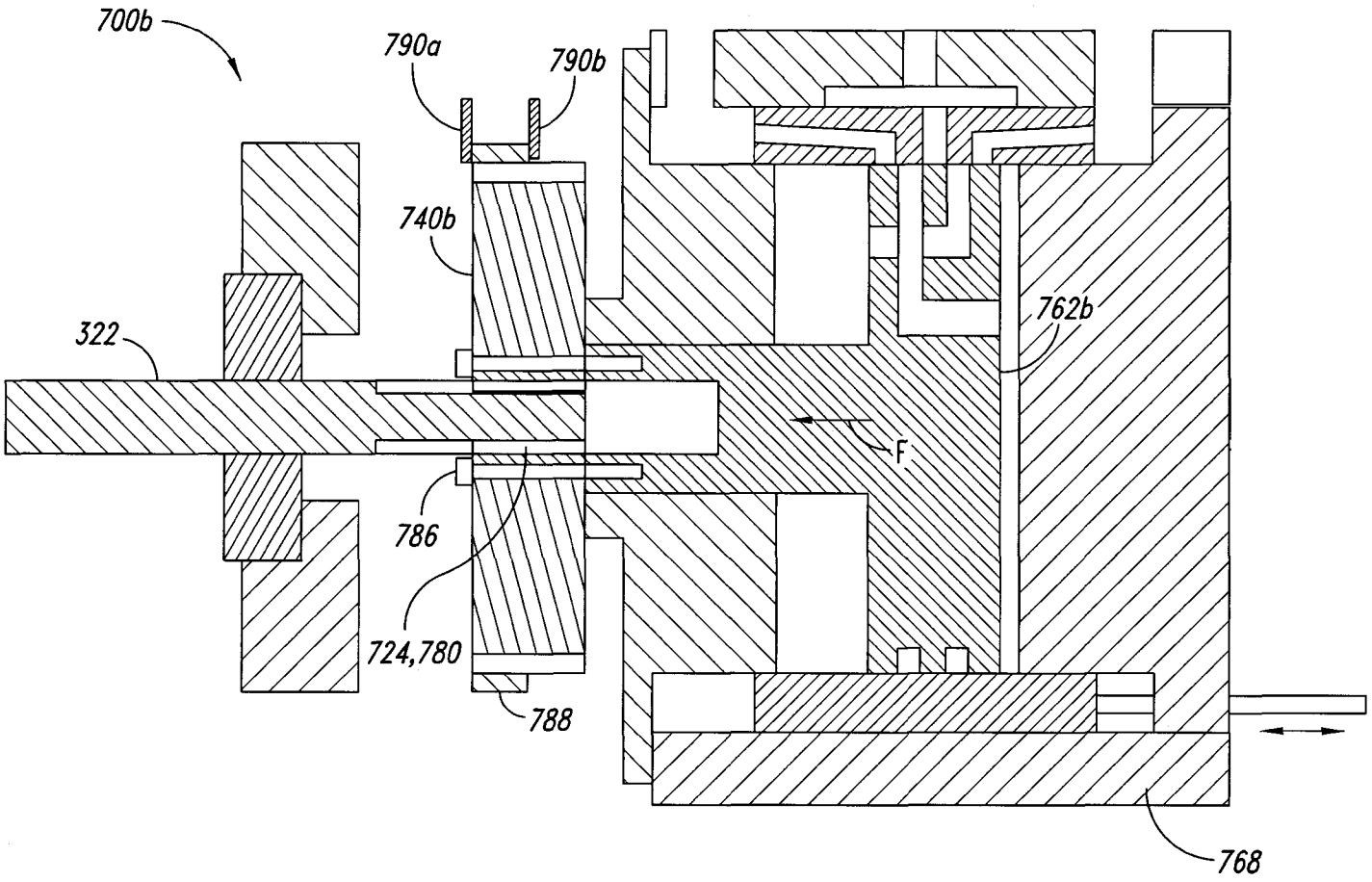

FIG. 7B illustrates a phaser 700*b* that has many features and components which are generally similar in structure and function to the phaser 700*a* described above. For example, in this embodiment a phasing head 762*b* can be moved from left to right and vice versa as described above with reference to FIG. 7A. Moreover, the phasing head 762*b* can include, e.g., left hand helical gear teeth 780 which engaged complimentary helical gear teeth 724 on the crankshaft 322.

In the illustrated embodiment, however, a crankshaft drive member, such as a toothed pulley 740*b* is fixedly attached to a distal end of a phasing head 762*b* by one or more fasteners (e.g. bolts) 786. Accordingly, the pulley 740*b* moves with the phasing head 762*b* as the phasing head 762*b* moves back and forth horizontally relative to the crankcase 768. Moreover, in this embodiment the pulley 740*b* is operably coupled to, e.g., a corresponding camshaft (not shown) by means of a toothed belt 788. To accommodate the horizontal movement of the pulley 740*b*, belt guides 790*a* and 790*b* are positioned on opposite sides of the belt 788 to restrict lateral movement of the belt as the pulley 740*b* moves horizontally. In the foregoing manner, movement of the phasing head 762*b* in the direction F can functionally increase (or decrease) the phase angle between the crankshaft 322 and the corresponding valve/camshaft arrangement, while movement of the phasing head 762*b* in the opposite direction can reduce (or increase) the phase angle between the crankshaft 322 and the camshaft/valve.

Figure 7C:
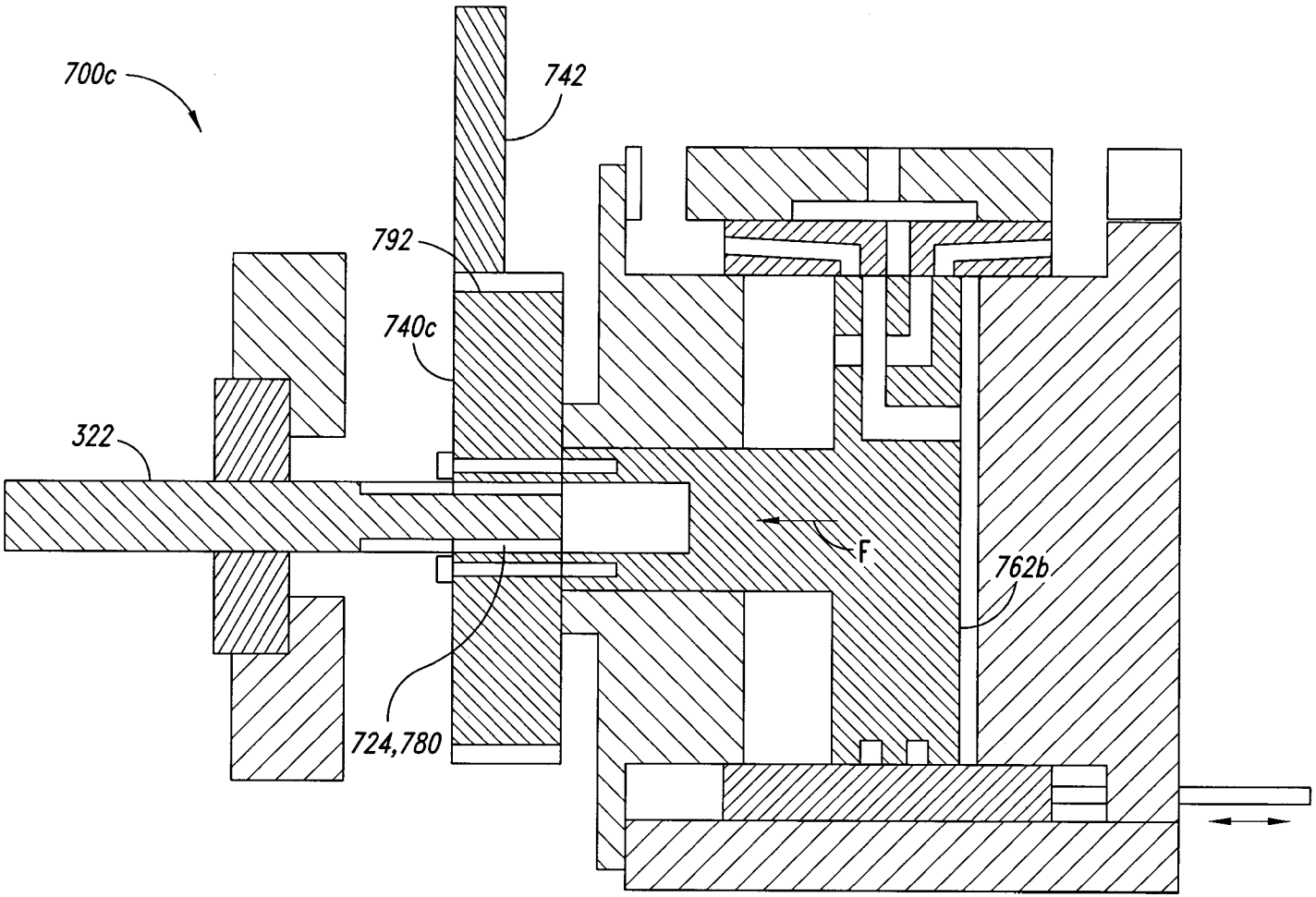

FIG. 7C illustrates yet another embodiment of a phaser 700*c* configured in accordance with the present technology. Many features and of the phaser 700*c* are at least generally similar in structure and function to the corresponding features of the phaser 700*b* described in detail above with reference to FIG. 7B. For example, in the illustrated embodiment a crankshaft gear 740*c* is fixedly attached to a distal end of the phasing head 762*b*. In this embodiment, however, the crankshaft gear 740*c* operably engages a power transfer gear 742 (e.g., a gear that couples the crankshaft 322 to a corresponding camshaft). The gear 742 can include either straight or helical gear teeth which engage corresponding gear teeth 792 on the outer perimeter of the crankshaft gear 740*c*. As the phasing head 762*b* moves the crankshaft gear 740*c* from, e.g., right to left, the angular relationship between the crankshaft gear 740*c* and the crankshaft 322 changes as described above, and the teeth 792 on the crankshaft gear 740*c* slide relative to the corresponding teeth on the gear 742 to keep the two gears operably engaged. As mentioned above, the crankshaft gear 740*c* and the power transfer gear 742 can include helical gear teeth as well as straight-cut gear teeth. If the gear teeth 792 are helical gear teeth that angle in a direction opposite to the helical gear teeth 724, then movement of the crankshaft gear 740*c* can result in additional phase change angle because of the opposite directions of the two sets of gear teeth.

Figure 8:
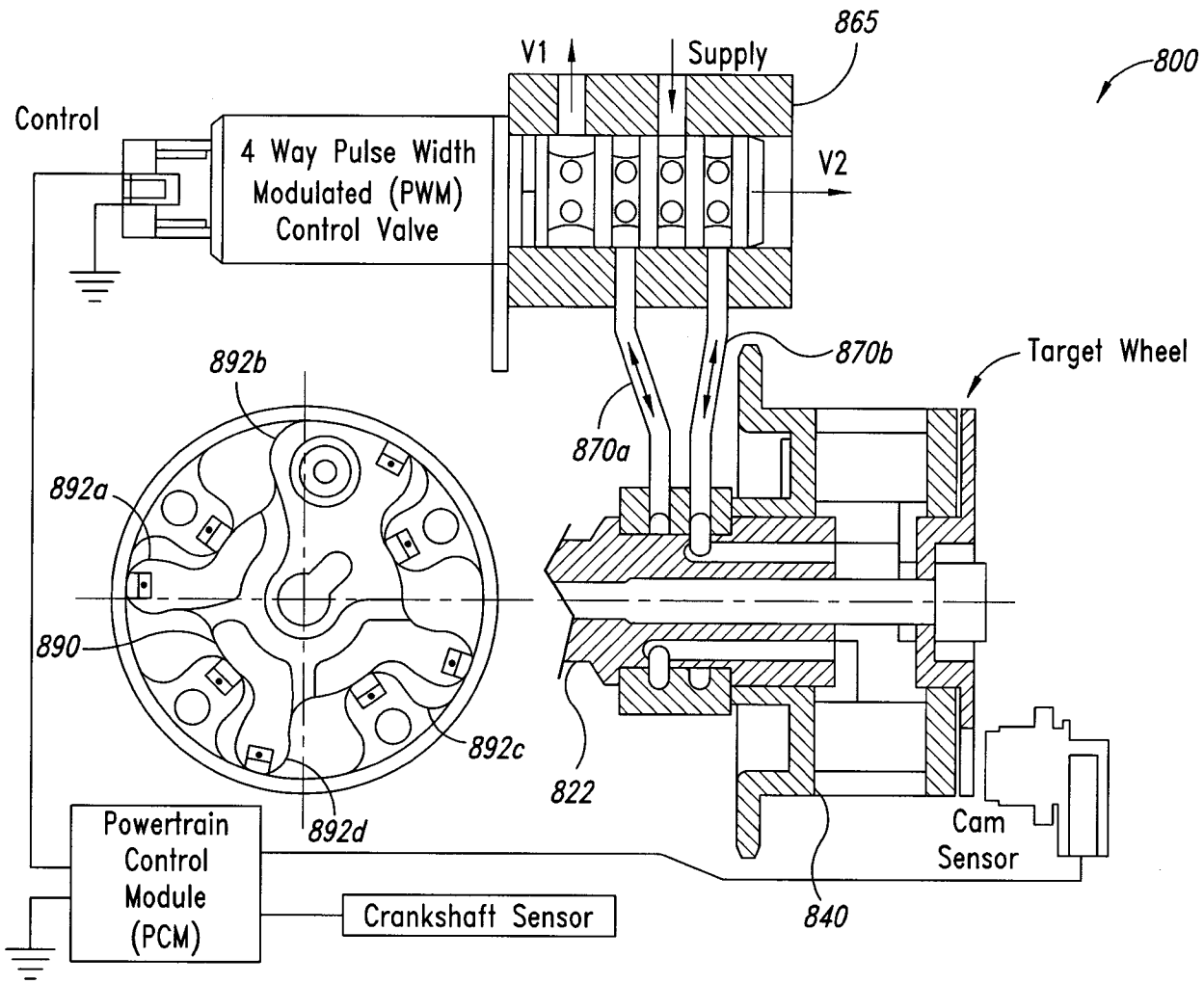
FIG. 8 is a partially schematic diagram illustrating another phaser system.

As mentioned above, the various systems and methods described above for changing the compression ratio and/or the valve timing in opposed-piston engines can be implemented using a wide variety of different phasers. FIG. 8, for example, is a schematic diagram of a phaser assembly 800 that can be utilized with various embodiments of the present technology. In the illustrated embodiment, the phaser assembly 800 can be at least generally similar in structure and function to a commercially available variable cam phaser provided by Delphi Automotive LLP. In the illustrated embodiment, the phaser assembly 800 includes a camshaft 822 coupled to a phasing head 890 having a first lobe 892*a*, a second lobe 892*b*, a third lobe 892*c*, and a fourth lobe 892*d*. In operation, a control valve 865 controls the flow of oil either into or out of the cavities on opposite sides of the lobes 892 via supply passages 870*a* and 870*b*. Increasing the oil pressure on, e.g., the left side of each lobe 892 causes the phasing head 890 to rotate clockwise as viewed in FIG. 8. Conversely, increasing the oil pressure on the right side of each lobe 892 causes the phasing head 890 to rotate counterclockwise as the oil flows out of the opposing cavity via the return line 870*b*. In the foregoing manner, the angular position of the camshaft 822 (or a crankshaft) is changed with respect to a corresponding drive member, such as a gear, pulley, or sprocket 840. As the foregoing discussion with respect to FIG. 7A-8 illustrates, there are a number of different phasers and phaser assemblies that can be utilized with various embodiments of the present technology to change the phase angle between corresponding master and slave crankshafts to, for example, vary the compression ratio in an opposed-piston engine in accordance with the present disclosure.

The various embodiments and aspects of the invention described above can incorporate or otherwise employ or include the systems, functions, components, methods, concepts and/or other features disclosed in the various references incorporated herein by reference to provide yet further implementations of the invention.

The teachings of the invention provided herein can be applied to other systems, not necessarily the systems described above. The elements and functions of the various examples described above can be combined to provide further implementations of the invention. Some alternative implementations of the invention may include not only additional elements to those implementations noted above, but also may include fewer elements. Further, any specific numbers noted herein are only examples: alternative implementations may employ differing values or ranges.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

I claim:

1. A method comprising:

reciprocating a first piston between a first bottom dead center (BDC) position and a first top dead center (TDC) position according to a first piston timing;

reciprocating a second piston between a second BDC position and a second top dead center TDC position according to a second piston timing, a first crown of the first piston and a second crown of the second piston at least partially defining a combustion chamber of an opposed piston engine;

periodically opening and closing at least one passage in fluid communication with the combustion chamber according to a valve timing; and varying the compression ratio of the combustion chamber between a first engine cycle and second engine cycle, the varying of the compression ratio comprising changing at least one of the first piston timing and the second piston timing independently of the valve timing.

2. The method of claim 1, wherein the first piston is operably coupled to a first crankshaft and the second piston is operably coupled to a second crankshaft, and wherein the varying of the compression ratio comprises at least one of changing a first phase angle of the first crankshaft independently of the valve timing and changing a second phase angle of the second crankshaft independently of the valve timing.

3. The method of claim 1, wherein the first piston is operably coupled to a first crankshaft and the second piston is operably coupled to a second crankshaft, and wherein the varying of the compression ratio comprises at least one of retarding the first crankshaft independently of the valve timing and advancing the second crankshaft independently of the valve timing.

4. The method of claim 1, wherein the first piston and the second piston periodically define a minimum volume of the combustion chamber when the first piston reciprocates according to the first piston timing and the second piston reciprocates according to the second piston timing; and wherein the varying of the compression ratio causes an increase in the minimum volume.

5. The method of claim 1, wherein the first piston periodically arrives at the first TDC position concurrently with the second piston periodically arriving at the second TDC position when the first piston reciprocates according to the first piston timing and the second piston reciprocates according to the second piston timing when the compression ratio is not varied.

6. The method of claim 1, wherein the first piston and the second piston periodically reach a first minimum separation distance when the first piston reciprocates according to the first piston timing and the second piston reciprocates according to the second piston timing; and wherein the varying of the compression ratio causes the first piston and the second piston to periodically reach a second minimum separation distance, greater than the first minimum distance.

7. The method of claim 1, wherein the periodically opening and closing of the at least one passage comprises periodically opening and closing an inlet passage according to an intake valve timing and periodically opening and closing an exhaust passage in fluid communication with the combustion chamber according to an exhaust valve timing; and wherein the varying of the compression ratio comprises changing the at least one of the first piston timing and the second piston timing independently of at least one of the intake valve timing and the exhaust valve timing.

8. The method of claim 1, wherein the first piston reciprocates in a first sleeve valve and the second piston reciprocates in a second sleeve valve, wherein the periodically opening and closing of the at least one passage comprises periodically opening and closing the first sleeve valve according to the valve timing and periodically opening and closing the second sleeve valve according to a second sleeve valve timing; and wherein the varying of the compression ratio comprises changing the at least one of the first piston timing and the second piston timing independently of at least one of the first sleeve valve timing and the second sleeve valve timing.

9. The method of claim 1, wherein the opposed piston engine further comprises a first crankshaft synchronously coupled to a second crankshaft, wherein the first piston is operably coupled to the first crankshaft and the second piston is operably coupled to the second crankshaft, and wherein the varying of the compression ratio comprises rotationally retarding the first crankshaft and rotationally advancing the second crankshaft.

10. The method of claim 1, wherein the opposed piston engine further comprises a slave crankshaft synchronously coupled to a master crankshaft, wherein the first piston is operably coupled to the slave crankshaft and the second piston is operably coupled to the master crankshaft, and wherein the varying of the compression ratio comprises rotationally retarding the slave crankshaft and rotationally advancing the master crankshaft.

11. An apparatus comprising:

a first crankshaft operably coupled to a first piston;

a second crankshaft operably coupled to a second piston, the first and second pistons arranged such that a first piston crown of the first piston and an opposed second piston crown of the second piston at least partially define a combustion chamber between the first piston crown and the second piston crown, and wherein the first piston crown and the second piston crown move toward one another as the first and second pistons approach respective first and second top dead center positions and away from one another as the first and second pistons approach respective first and second bottom dead center positions;

a phasing system for varying a first phase angle of the first crankshaft relative to a second phase angle of the second crankshaft, the phasing system comprising a phaser operably coupled to at least one of the first crankshaft and the second crankshaft, the varying of the first phase angle relative to the second phase angle occurring independently of a valve timing of at least one valve controlling fluid flow into and/or out of the combustion chamber.

12. The apparatus of claim 11, wherein the first piston reciprocates in a first bore and the second piston reciprocates in a second bore.

13. The apparatus of claim 11, wherein operation of the at least one phaser causes either or both of adjustment of the first phase angle of the first crankshaft about a first fixed axis about which the first crankshaft rotates and adjustment of the second phase angle of the second crankshaft about a second fixed axis about which the second crankshaft rotates, the first fixed axis being spaced apart from the second fixed axis.

14. The apparatus of claim 11:

wherein the first crankshaft is operably coupled to a first drive member, and wherein operation of the first phaser rotates the first crankshaft relative to the first drive member about a first fixed axis; and wherein the second crankshaft is operably coupled to a second drive member, and wherein operation of the second phaser rotates the second crankshaft relative to the second drive member about a second fixed axis spaced apart from the first fixed axis.

15. The apparatus of claim 11, further comprising:

a first sleeve valve configured to move back and forth to open and close a first passage in fluid communication with the combustion chamber during operation of the engine, wherein the first bore is disposed in the first sleeve valve; and a second sleeve valve configured to move back and forth to open and close a second passage in fluid communication with the combustion chamber during operation of the engine, wherein the second bore is disposed in the second sleeve valve.

16. The apparatus of claim 11, further comprising:

a first sleeve valve at least partially encircling the first piston and configured to reciprocate to open and close a first passage in fluid communication with the combustion chamber;

a second sleeve valve configured to move back and forth to open and close a second passage in fluid communication with the combustion chamber; a camshaft operably coupled to at least the first sleeve valve to cause the reciprocating of the first sleeve valve; and an additional phaser operably coupled to the camshaft, wherein operation of the additional phaser changes the phase angle of the camshaft relative to at least the first crankshaft during operation of the engine.

17. The apparatus of claim 11, further comprising:

an intake sleeve valve at least partially encircling the first piston and configured to reciprocate to open and close an intake passage in fluid communication with the combustion chamber;

an exhaust sleeve valve at least partially encircling the second piston and configured to reciprocate to open and close an exhaust passage in fluid communication with the combustion chamber;

a camshaft operably coupled to at least the intake sleeve valve to cause the reciprocating of the intake sleeve valve; and an additional phaser operably coupled to the camshaft, wherein operation of the additional phaser changes the timing of the intake sleeve valve relative to at least the first piston.

18. An internal combustion engine comprising:

a first crankshaft operably coupled to a first piston;

a second crankshaft operably coupled to a second piston, the first and second pistons arranged such that a first piston crown of the first piston and a second piston crown of the second piston at least partially define a combustion chamber;

an intake valve operable to open and close an intake port to the combustion chamber, the intake valve being associated with the first crankshaft;

an exhaust valve operable to open and close an exhaust port to the combustion chamber, the exhaust valve being associated with the second crankshaft;

a phasing system for varying a first phase angle of the first crankshaft relative to a second phase angle of the second crankshaft, the phasing system comprising a phaser operably coupled to at least one of the first crankshaft and the second crankshaft, wherein varying of the first phase angle relative to the second phase angle changes a compression ratio of the internal combustion engine.

19. The internal combustion engine of claim 18, wherein the phasing system causes the intake valve and the exhaust valve to be phased independently and/or differently than the first and second crankshafts.

* * * * *